US005645509A

United States Patent [19]

Brewer et al.

[11] Patent Number: 5,645,509

[45] Date of Patent: Jul. 8, 1997

[54] REMOTE EXERCISE CONTROL SYSTEM

[75] Inventors: Dane P. Brewer; Curt G. Bingham, both of Salt Lake City, Utah

[73] Assignee: Icon Health & Fitness, Inc., Logan, Utah

[21] Appl. No.: 278,994

[22] Filed: Jul. 22, 1994

Related U.S. Application Data

[63] Continuation of Ser. No. 990,605, Dec. 14, 1992, abandoned, which is a continuation of Ser. No. 836,105, Feb. 14, 1992, abandoned, which is a continuation-in-part of Ser. No. 724,732, Jul. 2, 1991, Pat. No. 5,512,025.

[51] Int. Cl.[6] ..... A63B 24/00

[52] U.S. Cl. ..... 482/4; 482/54; 482/901; 379/106.01

[58] Field of Search ..... 482/1, 4–8, 54, 482/57, 72, 91, 93, 900–903; 601/23; 73/379.01, 379.07; 379/92–94, 102, 106; 348/61, 121

[56] References Cited

U.S. PATENT DOCUMENTS

| | | | |
|---|---|---|---|
| 3,903,613 | 9/1975 | Bisberg | 482/4 X |
| 4,120,294 | 10/1978 | Wolfe | 128/706 |
| 4,278,095 | 7/1981 | Lapeyre | 482/8 |
| 4,358,105 | 11/1982 | Sweeney, Jr. . | |
| 4,408,613 | 10/1983 | Relyea | 482/900 X |
| 4,571,682 | 2/1986 | Silverman et al. | 482/901 X |
| 4,708,337 | 11/1987 | Shyu . | |
| 4,790,528 | 12/1988 | Nakao et al. | 482/901 X |
| 4,828,257 | 5/1989 | Dyer et al. | 482/901 X |
| 4,869,497 | 9/1989 | Stewart et al. . | |
| 4,907,795 | 3/1990 | Shaw et al. | 482/901 X |
| 4,911,427 | 3/1990 | Matsumoto et al. | 482/902 X |
| 4,919,418 | 4/1990 | Miller | 482/8 X |
| 4,976,435 | 12/1990 | Shatford et al. | 482/902 X |
| 4,998,725 | 3/1991 | Watterson et al. . | |
| 5,020,795 | 6/1991 | Airy et al. | 482/901 X |
| 5,037,089 | 8/1991 | Spagnolo et al. . | |
| 5,104,120 | 4/1992 | Watterson et al. . | |
| 5,142,358 | 8/1992 | Jason | 358/93 |

FOREIGN PATENT DOCUMENTS 199442A 10/1986 European Pat. Off. .

*Primary Examiner*—Joe H. Cheng
*Attorney, Agent, or Firm*—Trask, Britt & Rossa

[57] ABSTRACT

An exercise system is comprised of an exercise machine, an external source of input signals, a control console and a display. The control console is associated with the exercise machine having an adjustment structure for a moveable member such as an endless belt on a powered treadmill or the pedals of an exercise cycle. Adjustment structures are connected to regulate the speed of the movable member as well as the resistance to movement. The control console has programs selectable and alterable from the external source at a remote location. A program supplies a variable input over selected time segments to regulate and control the adjustment structure such as the motor controller of the treadmill or a resistance strap associated with an inertia wheel of the exercise cycle. Input is received from a remote location over a telecommunications network such as from an external computer interconnected via a local computer network or via telephone lines to modify, to select or to supply the exercise programs of the control console for operation of the related exercise machine.

16 Claims, 42 Drawing Sheets

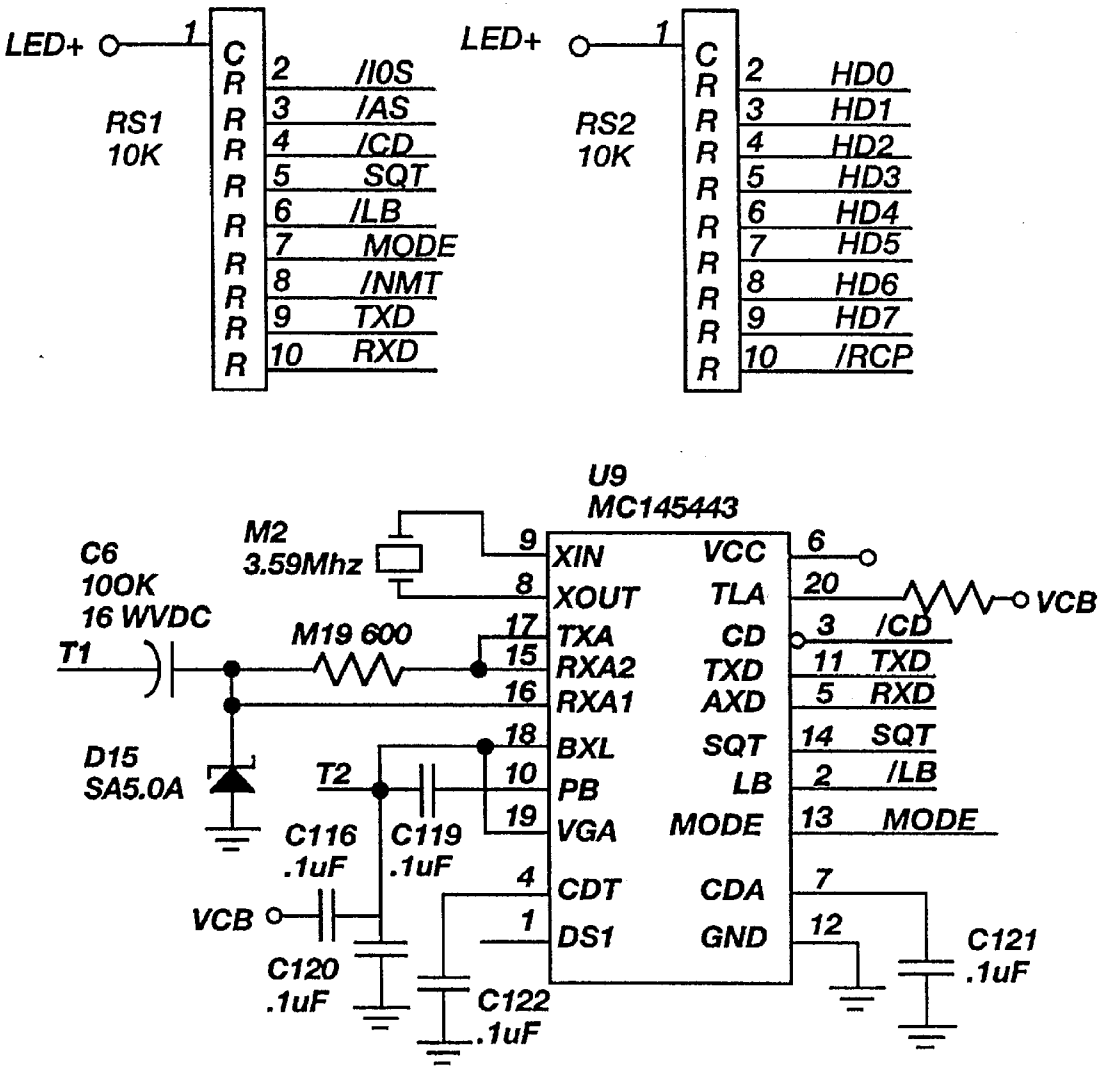
Fig. 14F
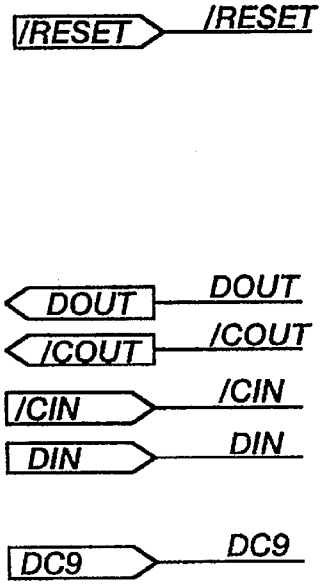

SB | D7 | D6 | D5 | D4 | P1 | D3 | D2 | D1 | D0 | P2 | E3 | E2 | E1 | E0 | P3 •••

TIME INCREASES IN THIS DIRECTION------>
(NOTE: EACH RECEIVED BIT LASTS FOR 10mSEC.;
TOTAL PACKET TIME IS 160 mSEC.)

BLANK -- NO DATA -- SB | D7 | D6 | D5 | •••

(NOTE: BETWEEN EACH PACKET OF DATA IS A "DEAD" PERIOD OF 100 mSEC.;
TOTAL PACKET TIME WITH DEAD PERIOD IS 260 mSEC.)

Fig. 22

PACKET DATA BIT DESCRIPTION:

| DEFINITION | VALUE |
|---|---|
| SB = START BIT | 1 |
| D7 = DATA BIT 7 | x SPEED VALUE, BIT 4, MSB |
| D6 = DATA BIT 6 | x SPEED VALUE, BIT 3 |
| D5 = DATA BIT 5 | x SPEED VALUE, BIT 2 |
| D4 = DATA BIT 4 | x SPEED VALUE, BIT 1 |
| P1 = ODD PARITY BIT 1 | ODD PARITY BIT FOR BITS D4-D7 |
| D3 = DATA BIT 3 | x SPEED VALUE, BIT 0, LSB |
| D2 = DATA BIT 2 | x INCLINE VALUE, BIT 2, MSB |
| D1 = DATA BIT 1 | x INCLINE VALUE, BIT 1 |
| D0 = DATA BIT 0 | x INCLINE VALUE, BIT 0, LSB |
| P2 = ODD PARITY BIT 2 | ODD PARITY BIT FOR BITS D0-D3 |
| E3 = EXCLUSIVE OR BIT 3 | XOR VALUE OF D7 AND D3 |
| E2 = EXCLUSIVE OR BIT 2 | XOR VALUE OF D6 AND D2 |
| E1 = EXCLUSIVE OR BIT 1 | XOR VALUE OF D5 AND D1 |
| E0 = EXCLUSIVE OR BIT 0 | XOR VALUE OF D4 AND D0 |
| P3 = ODD PARITY BIT 3 | ODD PARITY BIT FOR BITS E0-E3 |

Fig. 23

| COLUMN | 1 | 2 | 3 |
|---|---|---|---|
| ROW 1 | D7 | D3 | E3 |
| ROW 2 | D6 | D2 | E2 |
| ROW 3 | D5 | D1 | E1 |
| ROW 4 | D4 | D0 | E0 |
| ROW 5 | P1 | P2 | P3 |

Fig. 24

*SOFTWARE IMPLEMENTATION:* *DATA CAN BE ACCURATELY RECEIVED BY A MICRO COMPUTER USING THE FOLLOWING TECHNIQUE:*

- *BEGIN WITH A TIMER INTERRUPT ROUTINE USING A 1 mSEC INTERVAL.*
- *POLL THE INCOMING DATA BIT UNTIL A CONTINUOUS SEQUENCE OF 0'S HAS BEEN RECEIVED FOR A MINIMUM DURATION OF 95 mSECS. THIS ALLOWS THE SOFTWARE TO SYNC TO THE BEGINNING OF A PACKET.*
- *THEN POLL THE INCOMING DATA FOR THE LEADING EDGE OF THE START BIT.*
- *UPON DETECTION OF THE START BIT, EXAMINE AND STORE THE STATE OF THE INCOMING DATA ONCE EVERY 1 MILLI SECOND. IGNORE THE FIRST AND LAST (10TH) STATES.*
- *OF THE 10, 1 MILLI SECOND SAMPLES WHICH OCCUR WITH EACH RECEIVED DATA BIT, USE THE INNER 8 SAMPLES OF DATA TO GIVE THE SOFTWARE A METHOD OF VOTING ON WHAT THE ACTUAL RECEIVED BINARY BIT VALUE SHOULD BE. 8 COUNTS OF A BINARY VALUE OF "1" INDICATES STRONG SIGNAL RECEPTION OF THE START BIT, OR A BINARY BIT VALUE OF "1"; WHEREAS 5 COUNTS OF A BINARY VALUE OF "1" INDICATE WEAK RECEPTION OR SIGNAL QUALITY. THIS VOTING MECHANISM PROVIDES AN INDICATION OF SIGNAL STRENGTH. 5 THROUGH 8 BINARY VALUES OF "1" RECEIVED DURING THE INNER PORTION OF A BIT CELL WOULD BE VOTED ON AS A "1" HAVING BEEN RECEIVED, WHILE 0 THROUGH 4 BINARY VALUES OF "1" RECEIVED DURING THE INNER PORTION OF A BIT CELL WOULD BE VOTED ON AS A "0" HAVING BEEN RECEIVED.*
- *THE NEXT INNER 8 SAMPLES OF THE DATA PROVIDE THE SECOND RECEIVED BIT, DATA BIT 7. AGAIN, BY USING ONLY THE 8 (OUT OF A TOTAL OF 10) INNER SAMPLES OF A BIT CELL, THE SOFTWARE CAN ACCURATELY VOTE ON THE ACTUAL RECEIVED.*
- *THIS METHOD CAN BE USED TO RECEIVE ALL 16 DATA BITS IN THE PACKET. DUE TO TIMING JITTER OF THE PLAYBACK VCR, THE DATA BITS RECEIVED TOWARD THE END OF THE PACKET MAY HAVE LOWER SIGNAL STRENGTHS.*
- *BETWEEN PACKETS, THE SOFTWARE MUST EXAMINE THE PARITY/XOR INTEGRITY TO DETERMINE THE ACCURACY OF THE RECEIVED DATA.*
- *TWO ERROR FREE, IDENTICAL PACKETS MUST BE RECEIVED PRIOR TO ACTUALLY UPDATING ANY SPEED OR INCLINE INFORMATION.*

*Fig. 25*

REMOTE EXERCISE CONTROL SYSTEM

This application is a continuation of U.S. patent application Ser. No. 07/990,605, filed Dec. 14, 1992, now abandoned, which is a continuation of U.S. patent application Ser. No. 07/836,105, filed Feb. 14, 1992, now abandoned, which is a continuation-in-part of U.S. patent application Ser. No. 07/724,732, filed Jul. 2, 1991, now U.S. Pat. No. 5,512,025.

BACKGROUND OF THE INVENTION

1. Field

This invention relates to exercise equipment, more particularly to electronic control systems for such equipment. It is specifically directed to electronic control consoles and systems by which a user may regulate the movement and duration of segments of an exercise routine, and provides such a control in modular form.

2. State of the Art

It is generally accepted that an exercise program in which a prescribed routine is undertaken on a regular or repetitive basis over time (e.g., three times per week) is effective to secure the best results. To undertake such a program, it is desirable to perform the same exercises or routine for the same period or increased periods of time or to vary or increase the degree of difficulty for substantially the same time period.

Exercise machines typically available present the user with structure to vary the effort to be exerted by the user. For example, motorized treadmills typically have a speed control by which the user may vary the speed of the belt of the treadmill between stop and a maximum speed. The user in turn will need to vary the effort expended or the difficulty between the slow speed and the fast speed. Similarly, many exercise cycles have a strap frictionally positioned about a pedal driven flywheel. The user may vary the friction to in turn vary the strap friction and in turn the resistance to or the effort required of the user to move the pedals. Rowing machines, stepping machines and many other exercise machines all similarly have a frame with a movable element. Such machines also have adjustment means interconnected by which the movement by the user in the performance of exercise is adjusted or regulated. In turn, the user may adjust the effort required of the user or the difficulty involved to perform exercise.

Individuals vary in their exercise needs and desires. Many home exercise machines have a console or control system which is in effect a computer operable by a user to vary the exercise program and in turn the effort required of the user. Further, some consoles have means to store or retain one or more exercise programs for repetitive use. By performing the same exercise program at intervals (e.g., three times per week) over an extended time period (e.g., six months), a user can note his or her own increased capability to perform the exercise program and in turn note an increase in his or her own fitness level.

From time to time it may be desirable for a user to be able to modify a user-designed program, or to create and store multiple user-designed programs. In this way, the user may select an appropriate program according to which the degree of difficulty required or desired to follow or create a more varied exercise program having different exercise routines. Further, a mixture of exercise programs can enhance the effectiveness of the exercise.

From time to time it may also be desirable to present exercise programs with a related video image to enhance the exercise experience or to increase the user's interest. Even though video systems for use with exercise systems are known, an economical system employing readily available in-home equipment has not heretofore been disclosed.

Similarly, a user may from time to time desire to consult with an advises to modify exercise programs and routines based on the user's preferences, needs and goals. No system heretofore disclosed is structured to permit the user to communicate with an adviser at a remote location and for the adviser to set into the control console programs and routines of the adviser tailored to the user.

From another perspective, control consoles heretofore disclosed are single units which provide a fixed inventory of functions. No console provides the user with the ability to select and adapt separate input modules to in turn select desired operational features.

A need remains for an improved user-programmable console to control exercise machines including cycles, treadmills and steppers or climbers. Desirably, such a console would allow a user to select, with or without skilled guidance, from a wide variety of individualized programs. Further, such a console would have input modules that would permit an interconnection with remote controls such as a video system or a remote adviser.

SUMMARY OF THE INVENTION

The involved exercise machines are of the type or kind having a frame positionable on the support surface. A moveable element is connected to the frame for movement in the performance of exercise by a user. Adjustment means are also adapted between the frame and the moveable element to adjust or regulate the movement involved in the performance of exercise by the user. Support means may be associated with the frame between the frame and the support surface.

A control console for use with such an exercise machine has a chassis mountable to the frame. Input means are removably connectable to the chassis and operable to generate and supply a plurality of input signals reflective of a plurality of adjustments to the adjustment means to adjust or regulate the movement. Each of the plurality of adjustments extends for a specific time or time segment.

The chassis contains computation means which is configured to receive the plurality of input signals. The computational means is operable to compute and transmit a plurality of control signals reflective of the plurality of input signals and the respective plurality of adjustments. Output means are connected to receive the plurality of control signals from the computation means and convert the plurality of control signals to output signals. The output means is connectable to the adjustment means of the exercise machine to supply output signals to the adjustment means to adjust the movement of the movable element.

In one configuration the exercise machine has sensing means positioned to sense the movement of the movable member and for generating and supplying movement signals reflective of the movement. The computation means is configured to receive the movement signals and compute and transmit display signals reflective of the movement signals. The chassis also includes display means positioned for observation by a user during performance of exercise. The display means is connected to the computation means to receive the display signals and is operable to display indicia reflective of the movement signals.

The chassis may also have input means operable by the user to supply operation signals. The computation means is connected to receive the operation signals and supply second display signals to said display means reflective of the operation signals. The display means is operable to receive the second display signals and display indicia reflective of the operation signals.

In a preferred configuration, the input means comprises a plurality of input modules. Each of the input control modules has module connection means to connect electrically with corresponding chassis connection means of the chassis. Each input module has means to generate a unique plurality of input signals reflective of a unique plurality of adjustments to the adjustment means to adjust or regulate one movement in each of the corresponding time segments.

In a more preferred arrangement, a first input module has microprocessor means for generating input signals. The microprocessor means is structured to contain a first program which is a first plurality of input signals and a second program which is a second plurality of input signals. The first input module is also operable by the user to select between the first program and the second program to in turn supply the selected of the two programs through the module connection means and the chassis connection means to the computation means.

In an alternate configuration, the first input module includes means for the user to select a third plurality of input signals reflective of adjustments to the movement over a preselected time. The third plurality is a user designed program and is inserted into the microprocessor as one of the first or second programs.

In yet another arrangement, the input module includes a module display means to receive display signals to display indicia reflective of the adjustment of the adjustment means to adjust the movement of the moveable element of the exercise machine. The display means also has indicia reflective of the various time segments of the selected first or second program.

The module display means is connected to the microprocessor means to receive the display signals therefrom; and the display signals are reflective of the input signals. Desirably, the module display means includes a plurality of columns of indicators. Each of the plurality of columns corresponds to a respective time segment; and each of the indicators corresponds to an adjustment of the adjustment means. The indicators are preferably ordered within each of the columns to indicate the range of adjustments of the adjustment means between an easy position reflecting easy movement by the user in the performance of exercise and a difficult position reflecting difficult movement by the user in the performance of exercise. Each indicator is preferably operable between an activated and a deactivated state. The range of adjustment in each time segment is represented by activation of a preselected number of indicators in each of the columns. The indicators may optionally be LEDs which are lit when activated and unlit when deactivated.

In one specific arrangement, the exercise apparatus is a treadmill in which the moveable element is a treadmill belt. The adjustment means includes speed adjustment means for adjusting the speed of the treadmill belt. Such speed adjustment means is a motor controller with a motor connected to drive the treadmill belt. The output signals in this configuration are speed signals connected to vary the speed of the treadmill motor and in turn the belt. The adjustment means may also include means for adjusting the incline of the treadmill relative to the support surface.

Alternatively the exercise apparatus may be an exercise cycle in which the moveable element is a pedal system interconnected to drive a wheel like an inertia wheel. The adjustment means adjusts the resistance to operation of the pedals by adjusting the resistance to movement of the wheel. The output signals are resistance signals which vary the resistance to movement of the wheel.

In one preferred arrangement, a first input module has fitness level adjustment means operable by the user and connected to the microprocessor means to supply fitness level signals thereto. The microprocessor means is configured to receive the fitness level signals and to vary the relative values of the plurality of input signals in accordance with fitness level signals.

In another configuration, a second input module has microprocessor means structured to supply a plurality of input signals. The second input module has external connection means connectable to receive external control signals from an external source. The external connection means are connected to the microprocessor means to supply the external control signals thereto. The microprocessor means is structured to generate a plurality of input signals in accordance with and reflective of the external control signals.

The second input module may also have fitness level adjustment means operable by the user and connected to the microprocessor means to supply fitness level signals thereto similar to the fitness level adjustment means associated with the first input module.

The first input module in one arrangement has a segment selection means operable by the user and connected to the microprocessor means to supply signals thereto to vary the time of each of the time segments. The first input module may also include indication means to indicate the programs selected by the user. The indication means is connected to the microprocessor means to receive signals indicative of the program selected.

In an alternate assembly, the exercise machine includes sensing means to sense the movement of the moveable element and transmit movement signals reflective thereof. The computation means is connected to the sensing means to receive the movement signals and to the microprocessor means through the module connection means and the chassis connection means to supply signals reflective of the movement signals. The external connection means is connected to the microprocessor means to receive signals therefrom and to the external source to supply signals reflective of the movement signals to the external source.

In a configuration having a plurality of columns of indicators to indicate the adjustment of said adjustment means, the number of columns of indicators is less than the number of time segments of a program. The first input module in such a configuration has control means operable by the user and connected to the microprocessor means to vary the display signals to scroll a plurality of adjustment levels for consecutive time segments across one plurality of columns.

In the preferred construction, the chassis of the control console has a housing portion and a support member connected thereto. The support member extends away from the housing portion which is configured to receive and support the first input module thereof. The housing portion and the support member are preferably configured to form a shoulder. The first input module is desirably configured to abut the shoulder. In a highly preferred arrangement the chassis connection means is positioned proximate the shoulder for connection with the module connection means of the first input module. In a highly preferred embodiment, each input module has a unique module connection configuration for interconnection to a corresponding unique chassis connection configuration.

An alternate preferred arrangement involves an exercise machine of the type hereinbefore described as well as a chassis of the type hereinbefore described. The system includes a source of external control signals which are reflective of a plurality of input signals. The first input module of the system includes external connection means for connection to an external source to receive the external control signals and to transmit means to the microprocessor means which in turn supplies the plurality of input signals in accordance with the external control signal.

In a preferred arrangement, the external source is a VCR interconnected to supply television signals to a television. The VCR is also connected to supply signals to the external connection means of the input module to supply external control signals thereto. The VCR includes a video tape with exercise signals thereon. The VCR also includes means to extract the exercise signals and generate the external control signals reflective thereof. The video tape also includes a first video signal in which the VCR converts to a first television signal to display images related to the exercise signals. The video tape also desirably includes a second video signal which the VCR converts to a second television signal to simultaneously display images reflective of the plurality of adjustments in each time segment and the length of each time segment. The video tape most desirably includes a third video signal which the VCR converts to a third television signal to display images reflecting each external control signal has been transmitted beginning with the first of the time segment of an exercise program.

The external control signals on the video tape are preferably audio signals which are intermittently supplied by the VCR in a preselected pattern to the input module.

In an alternate assembly, the external source is a computer interconnected through transmission means to supply a first plurality of input signals as a first program and a second plurality of input signals as a second program. The transmission means is desirably configured to receive an output from the computer and convert that output for transmission through a telephone system interconnected to the external connection means as external control signals.

The exercise machine of the alternate assembly preferably includes sensing means positioned to sense the movement of the moveable element and to supply movement signals reflective thereof. The computation means includes means to receive the movement signals and supply first use signals reflective of the movement signals to the input module means. The input module means has means to receive the first use signals and store them. The input module means also has means to supply second use signals which are reflective of the first use signals to the external connection means for further transmission to the computer means via the transmission means.

BRIEF DESCRIPTION OF THE DRAWINGS

In the drawings, which illustrate what is presently regarded as the best mode for carrying out the invention:

FIGS. 14A, 14B, 14C, 14D, 14E, 14F, 14G are construction circuit diagrams of the first input module of FIG. 13;

FIG. 22 is a table (table 1) illustrating a 16 bit signal.

DESCRIPTION OF THE ILLUSTRATED EMBODIMENTS

Figure 1:
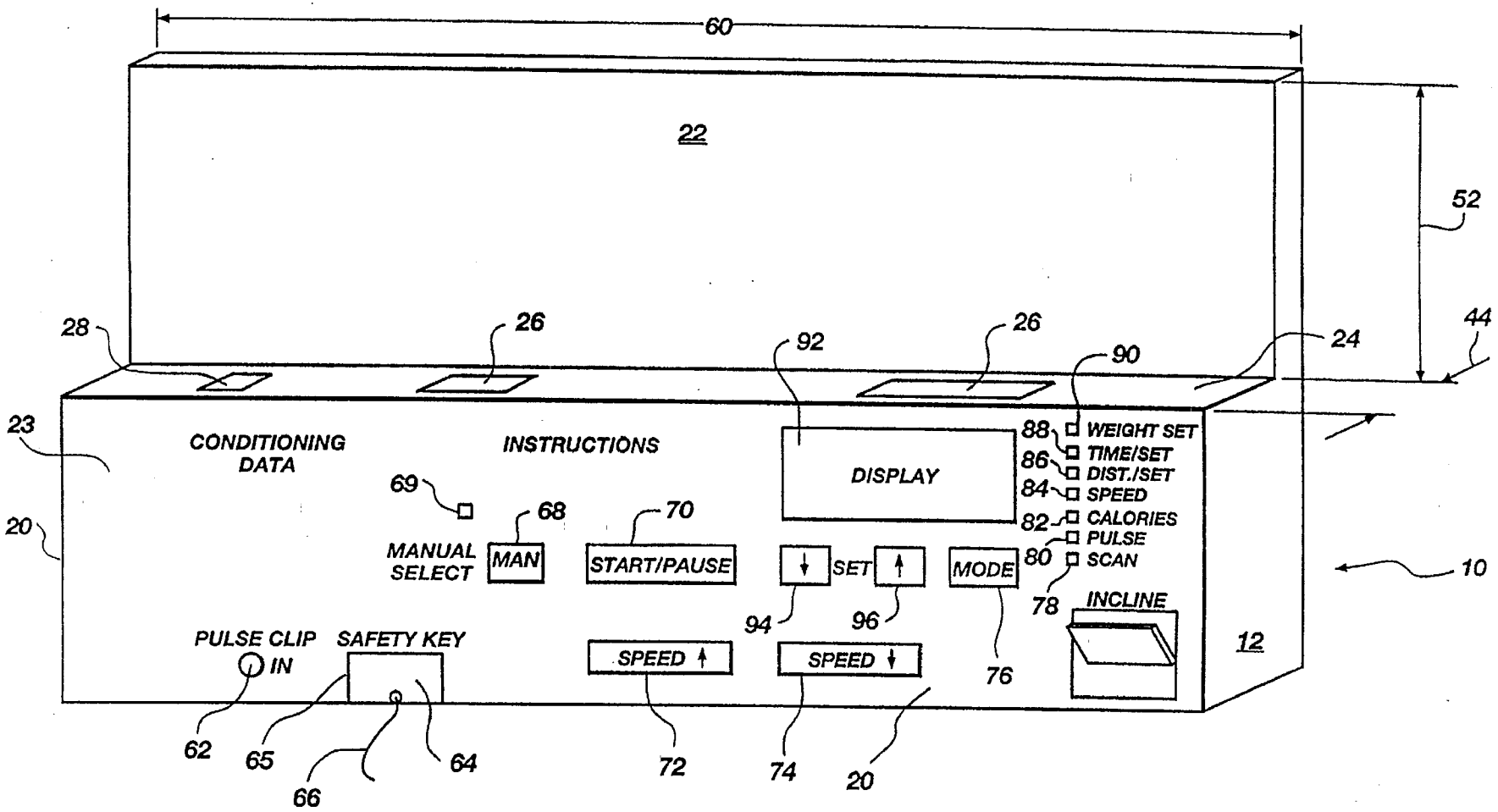
FIG. 1 is a chassis of a control console of the instant invention which is mountable to the frame of an exercise machine.
Figure 2:
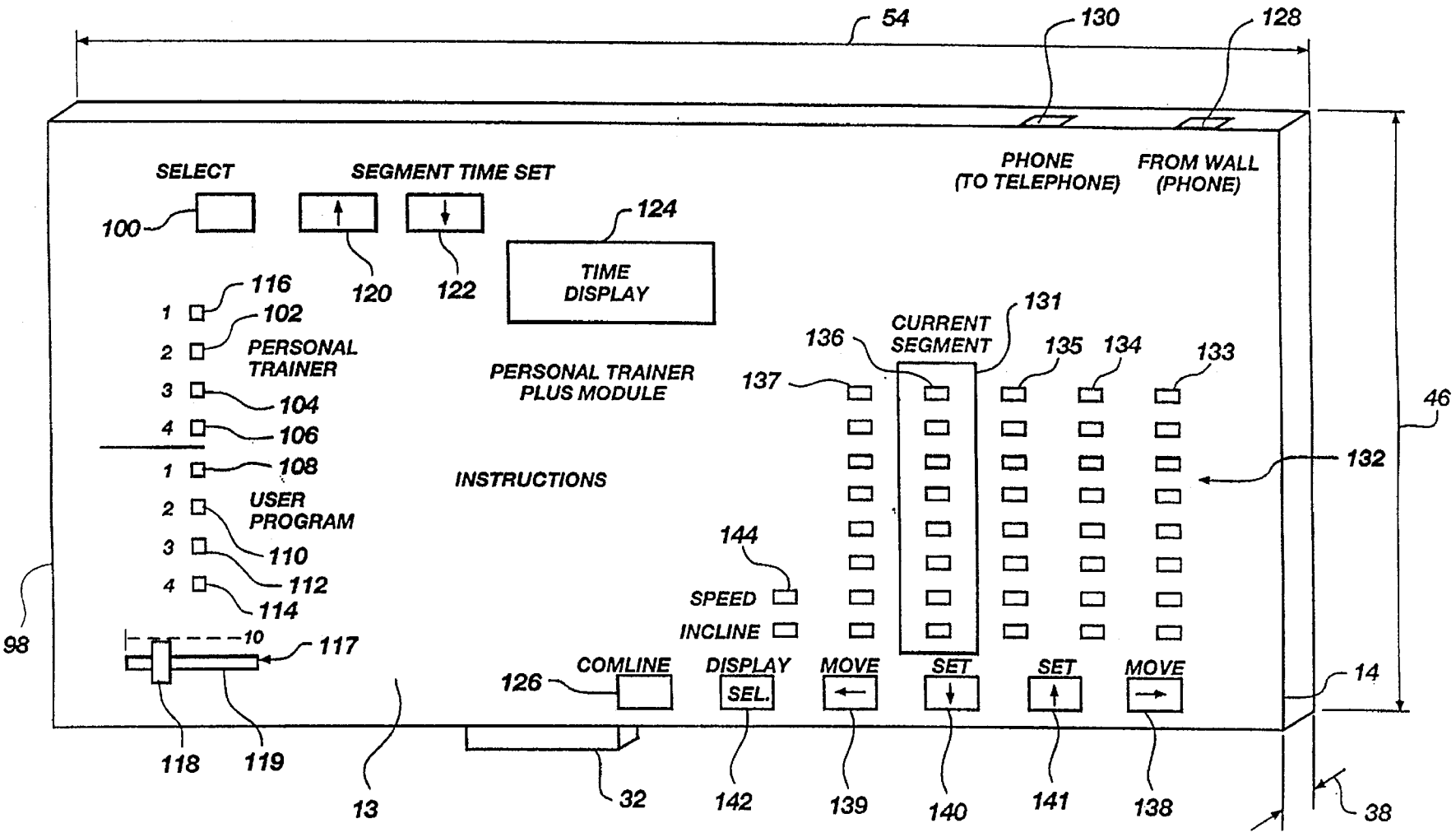
FIG. 2 is a first input module for interconnection to the chassis of FIG. 1.
Figure 4:
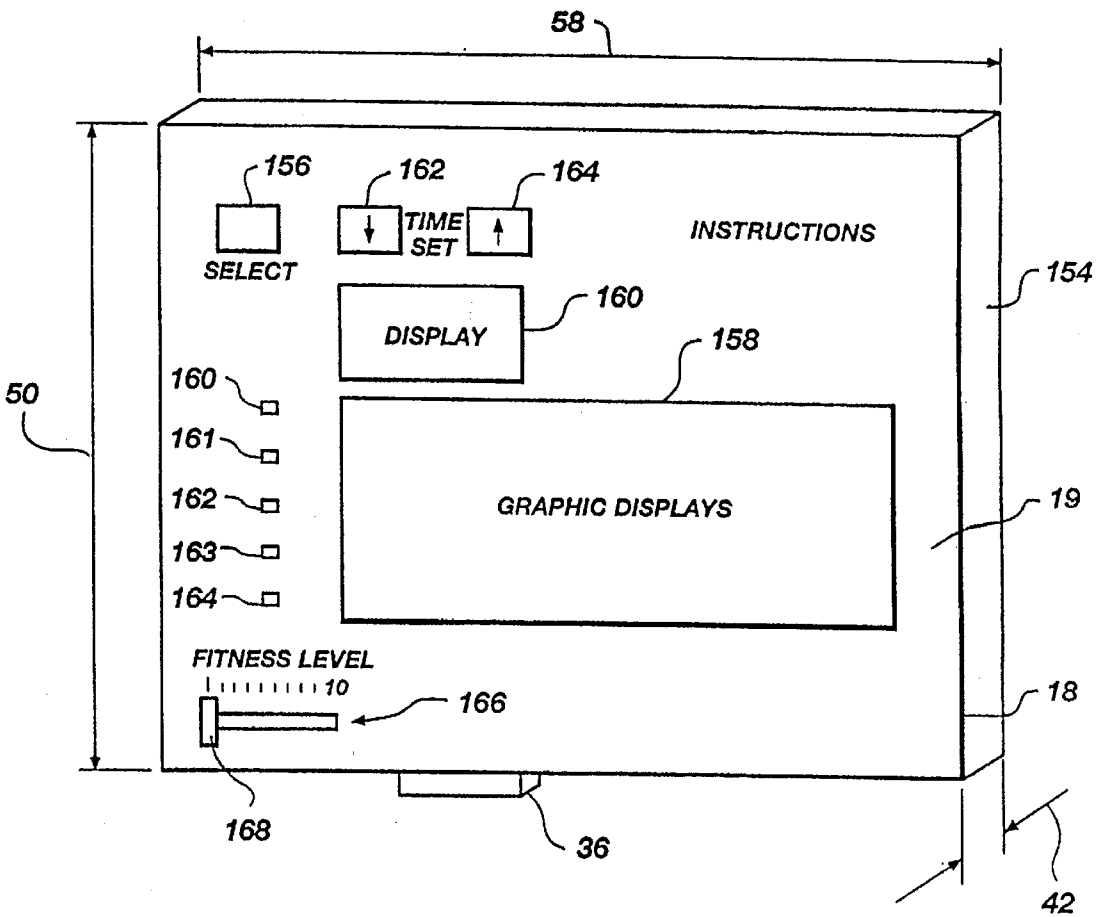
FIG. 4 is a third input module for interconnection to the chassis of FIG. 1.
Figure 3:
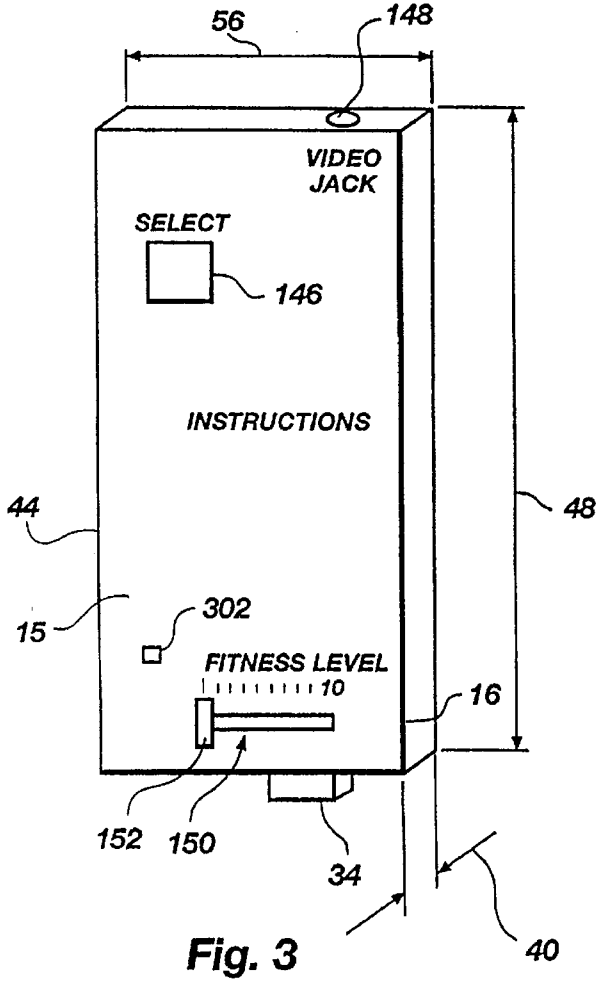
FIG. 3 is a second input module for interconnection to the chassis of FIG. 1.

Referring to FIGS. 1–4, a control console 10 has a chassis 12 configured to receive one of a plurality of input modules. FIG. 2 shows a first input module 14; FIG. 3 shows a second input module 16; and FIG. 4 shows a third input module 18. The input modules 14, 16 and 18 may be separately or simultaneously connected to the chassis 12.

The chassis 12 of FIG. 1 has a housing portion 20 with a support member 22 connected thereto and extending away therefrom. As can be seen from FIG. 1, the support member 22 extends away from the housing portion 20 to form in effect a type of shelf to receive and support one or more of the selected input modules 14, 16 and 18.

More specifically, the housing portion 20 and the support member 22 are formed to create a lip 24 against which the separate input modules 14, 16 and 18 may abut. The lip 24 has chassis connection means formed therein for interconnection with corresponding module connection means of the separate modules 14, 16 and 18. As here specifically illustrated, the chassis connection means includes a first chassis connector 26, second chassis connector 28 and a third chassis connector 30. The first input module of FIG. 14 and FIG. 2 have a module connector 32 sized and configured to electrically effect an interconnection through the first chassis connector 26. Similarly the second module 16 of FIG. 3 has a module connector 34 sized and configured to interconnect with the second chassis connector 28. In like manner, the third module 18 of FIG. 4 has a module connector 36 which is sized and configured to interconnect with the second module connection 28 formed in the lip 24 of the chassis 12.

It may be noted that the input modules 14, 16 and 18 each have a thickness 38, 40 and 42 corresponding to the thickness 44 of the lip 24. The modules 14, 16 and 18 also have a corresponding height 46, 48 and 50 which is the same as height 52 of the support member. Where the modules 12, 14 and 16 are installed on the lip 24 and support on the support member 22, the face 23 of the chassis 12 is essentially flat or in line with the outer surfaces 13, 15 and 19 of the modules. Notably each module 14, 16 and 18 is sized in with 54, 56 and 58 to, in total, equal the width 60 of the support member 22.

It may be noted that other combinations of input modules may be provided based on the desires of the users and the nature of the machine to which the control console 10 is affixed.

The chassis 12 of FIG. 1 has a number of different controls associated therewith for operation of the exercise machine to which the control console 10 is affixed. More specifically, the chassis 12 has a pulse clip connector 62 which is provided to receive input from a pulse clip of the type widely in use with a variety of commercial exercise machines. Such a pulse clip may clip to the ear lobe or to the finger tip in order to provide the control console 10 with a signal reflective of an individual's pulse during the performance of exercise. Connection is effected using a standard connection.

The chassis 12 may also have a safety key 64 which may be inserted into an associated safety key slot 65 to provide a safety shutoff. More specifically the safety key 64 has a lanyard 66 which may be affixed to the user by attachment to the user's belt, shirt or other similar attire. If the user slips or falls, the lanyard 66 would in turn cause the safety key 64 to be removed from its associated slot 65 to in turn disable the exercise machine to minimize the risk of injury to the user. A variety of different safety key arrangements may be used including the one described and illustrated in U.S. Pat. No. 5,034,576 (Dalebout, et al.).

The chassis 12 of FIG. 1 also has a manual select switch 68 which may be operated by the user in order to control the related exercise machine in a manual mode or to provide for automatic control through the use of a program of the type more fully described hereinafter. The manual select switch 68 may be depressed in order to activate and further depressed to deactivate in order to transfer the control console between an manual and an automatic mode of operation. An LED is activated to indicate operation in the manual mode.

The chassis 12 also has a start/pause switch 70 which may be depressed to start the operation of the control console 10 and in turn the associated exercise machine. Further depression of the start/pause switch 70 will interrupt operation of the control console and in turn the associated elements of the related exercise machine.

The chassis 12 also has associated with it a speed-up switch 72 and a speed-down switch 74. The speed-up 72 and speed-down 74 switches are operated by the user to increase or decrease the speed with the control console 10 in the manual mode (switch 68) when the associated exercise machine is a treadmill or other motorized device.

Chassis 12 also has a mode switch 76 which may be operated to select any one of the number of different display modes associated with each LED (Light Emitting Diode) 78, 80, 82, 84, 86, 88 and 90. That is, the user may selected an associated display mode by sequentially or consecutively depressing the mode switch 78. In turn the chassis 12 will cause the various LEDs 78–90 to sequentially illuminate. As each associated LED 78–90 is illuminated, the quantities depicted or indicated in the display 92 will be reflective of the selected display mode. For example, selection of the time set mode by depression of the mode switch 76 will cause the time set LED 88 to illuminate and cause the display 92 to reflect or indicate the time set for operation of the related exercise machine.

Operation of related set switches 94 and 96 causes the time set in the display 92 to increase or decrease and thus may be used by the operator to select the time for the duration of an exercise. Similarly, operation of the mode switch 76 to a "distance set" will illuminate the distance set LED 86 and will cause the selected distance to be depicted in the display 92. Operation of the increase or decrease switches 94 and 96 can in turn vary the distance selected by the user for a personalized exercise period.

The user may also input his or her own weight by operation of the mode switch 76 to illuminate the weight set LED 90. Operation of the mode switch may also be used to show calories being burned 82 and the pulse 80 of the user. In the scan mode 78, various modes are sequenced across the display 92 on a periodic basis. The display 92 is, of course, a LED array to reflect the desired numbers selected by operation of the mode switch 76.

Referring now to FIG. 2, the first input module 14 functions as an input means and supplies input signals to the chassis 12 which in turn generates a plurality of adjustment signals extending for corresponding plurality of time segments. More specifically, each of the plurality of input signals equates to corresponding plurality of adjustment signals which cause the adjustment means of the associated exercise machine to operate to a predesigned level or adjustment to regulate or adjust the movement in the performance of exercise by a user. Thus for example, the adjustment means may be the motor controller and motor for a treadmill to in turn regulate the speed of the motor which drives the belt of the treadmill. Alternately the adjustment means may adjust the tension on a friction strap to resist rotation of a fly wheel of a pedal driven exercise cycle. Alternately yet, the adjustment means may regulate the level of resistance to operation of treadles of a stepping machine or to operation of handles of a rowing machine. Each setting of the adjustment means is maintained for a preselected period of time which is a segment of an entire exercise program. The time segments are all normally selected to be of equal length. However, a user may adjust the length of the segments, if desired.

The input module 14 of FIG. 2 is itself positioned within a housing 98 which contains a variety of electronic components associated with the operation of the switches and display depicted in FIG. 2. More specifically the input module 14 has as select switch 100 which is operated by the user to cause the input module 14 to operate and supply input signals to the chassis 12 through the related module and chassis connection means 32 and 30 (FIG. 1). Subsequent operation of the selection switch 100 permits the user to select an appropriate user program itemized 1–4 and in turn activate a related LED 108–114. Subsequent operation of the select switch 100 also permits the user to select an appropriate identification as the personal trainer 1–4 indicated by LEDs 102–106 and 116.

More specifically the user program which is being selected by operation of the select switch 100 provides a specific unique set of input signals which in turn provides a unique set of adjustments to or settings to the adjustment means to regulate the movement for the corresponding time segment period even though four user programs are illustrated. Other configurations of the input module 14 may provide for any number of user programs as desired by the user in the construction of the module 14.

Further operation of the select button 100 in sequence permits the user to select personal trainer programs 1–4. That is the user may be identified as user 1, user 2, user 3 or user 4. Operation of the select button 100 causes the respective LEDs 116, 102, 104 and 106 to be illuminated to reflect the identity of the user then operating the control console 10 and in turn performing exercises on the associated exercise machine.

The input module 14 of FIG. 2 also has associated with it a fitness level selection switch 117. The switch 117 has a knob or handle 118 which the user may grasp to operate between the left (1) and the right (10) in the track 119. The handle 118 is associated with a slide potentiometer (not shown) which in operation changes the level of the input signals and in turn the output signals transmitted to the adjustment means and in turn the adjustment to the movement of the moveable element between and easy setting (1) and a more difficult setting (10). In other words, the user has a certain level of fitness which may vary from unfit to highly fit. The relative degree of difficulty or the degree of effort required by the user to perform exercise may be varied on a scale between 1 and 10 by moving the fitness level selection switch 117 as desired between 1 and 10.

The input module 14 of FIG. 2 also has segment time set switches 120 and 122. The segment time is displayed in the time display 124 and may be adjusted from zero to a maximum number of minutes selected in the design of the circuit. In FIG. 2, a COMLINE switch 126 is also illustrated. The COMLINE switch 126 engages or disengages the communication line by sequential activation of switch 126. The communication line is a telephone line which may be connected by plugging the line with a standard telephone connection jack into connector 128. A separate interconnection may be made from the module 14 to a telephone. A connecting wire with a jack on one end for interconnection at connector 130 extends to and is further connected to a telephone as more fully discussed hereinafter. In operation, the COMLINE switch 126 interconnects the phone line to receive signals from an external sources to the module 14 as more fully discussed hereinafter.

The module of FIG. 14 also has an array of LEDs 132 which here consists of 5 columns of LED indicators. Each of the columns 133 through 137 corresponds to a time segment of the plurality of time segments for the corresponding plurality of adjustments relating to the plurality of input signals. Each of the columns 133–137 indicates a range of adjustments between an easy position reflecting easy movement of the related moveable element of the associated exercise machine by the user in the performance of exercise and a difficult position reflecting difficult movement of the moveable element by the user in the performance of exercise. In the array 132 of FIG. 2 an illuminated LED is shown in dark and an unilluminated or unlit LED is shown as an open square. The easy position is reflected if no LEDs are illuminated. The difficult position is reflected by illuminating all of the LEDs in a particular column. If six LEDs are illuminated in column 135, then the relative level of the adjustment to the adjustment means is reflected to be at 75% of the most difficult which would be shown by illuminating all related 8 LEDs in the column. Column 134 could have five illuminated LEDs to reflect a difficulty level of five-eighths of the most difficult.

It may be noted that the array 132 has five separate columns, each reflecting five separate time segments. The first column 137 for the embodiment illustrated in FIGS. 14A, 14B, 14C, 14D, 14E, 14F, 14G reflects the most recently completed or past time segment. The current time segment is illustrated by a separate box 131 surrounding column 136. The next three segments to be experienced or to come in the course of performing the entire exercise program comprised of a plurality of input signals is reflected in columns 135, 134 and 133, in sequence.

The module 14 has a move switch to the right 138 and a move switch 139 indicating movement to the left. The move switches 138 and 139 are operable by depressing them. When the plurality of input signals and in turn the plurality of adjustments exceeds five, the user may move the displayed signals to the left by depressing button 139 and to the right by depressing button 138. The user may thereby visually observe the selected plurality of adjustments as desired. At the same time, the user may adjust the current segment adjustment level indicated by operating set switches 140 and 141 to set the adjustment level down 140 or the adjustment level up 141 as indicated. Thus, the user may create his own program by operating the set switches 140 and 141 as well as the move switches 138 and 139 to view a particular user program 1 through 4 as reflected by LEDs 108, 110, 112 and 114.

In FIG. 2, a separate select switch 142 is also operable by the user to select between speed and incline. That is, for an exercise machine which is a treadmill, the user typically has the ability to adjust not only the incline of the treadmill but also the speed of the related treadmill belt. The incline may be controlled by an incline motor and the belt is driven by an electrical motor. Each may be interconnected to receive control signals from the control console 10. The selected incline may be displayed on the LED array 132 or the speed adjustments may be displayed on the LED array 132 as desired by operation of the select switch 142.

FIG. 3 illustrates a second input module 16. It should be noted that reference herein to a first or second input module is strictly for purposes of convenience. The second module may operate as the only module or as the first or third module associated with the control console 10 and more specifically the chassis 12 as shown in FIG. 1. That is, the designation of first, second and third is not intended to suggest precedence, preference, or priority. The designations are only for convenience.

In reference to the second input module 16, it is also shown with a separate housing 144. A separate select switch is shown which is sequentially operable by the user to activate and deactivate and in turn connect or disconnect the module 16 from the chassis 12 through associated connectors 34 and 28.

The input module 16 has a video jack 148 which is sized to receive an input jack from a VCR as hereinafter discussed to receive external control signals therefrom. The module 16 also has a fitness level switch 150 which has a knob 152 operable between position 1 and 10 as indicated. The switch 150 is similar to the fitness level switch 117 of FIG. 2. The knob 152 is connected to a slidepot (variable resistor) to provide a variable output and adjust the plurality of input signals to a desired relative fitness level.

Referring now to FIG. 4, a third input module 18 is shown. The module 18 has a housing 154 to contain the various components. A select switch 156 is operable by the user to select any one of a plurality of programs which are illustrated in related graphic displays 158. That is, operation of the select switch first activates module 18 to in turn provide input signals from the module 18 through connector 36 and connector 26 (FIG. 1). Sequential operation of the select switch 158 results in selection of one of a plurality of programs which is here shown as five separate programs indicated by separate LEDs 160 through 164. That is, activation of any one of the LEDs 160 through 164 indicates that program (plurality or input signals) related to that LED is being transmitted by the module 18 through the connector 36 and connector 26 to the chassis 12.

As hereinbefore noted, the control console 10 of FIG. 1 may be used with a variety of different exercise machines. If the exercise machine involved is a treadmill, the graphic display 158 would, for example, reflect two lines to indicate speed as well as incline for the several time segments comprising the entire duration of the specific program. The graphic displays reflect a different level of speed and incline for each of the five illustrated programs. For a different type of machine, such as an exercise cycle, the illustration would reflect the degree of difficulty and in turn the incline being experienced by a user if that user were climbing and descending through selected terrain (on a bicycle) throughout the period of time comprising the various segments of the program.

The input module 18 also has a time segment display 160 to display the time segment. The length of each time segment may be adjusted by operation of time set switches 162 and 164.

The module 18 also has a fitness level switch 166 with a corresponding knob 168 which is operable between the left position indicated by 1 and the right position indicated by 10 comparable to fitness level switches 150 (FIG. 3) and 117 (FIG. 2). By operation of knob 168, the fitness level can be supplied to vary the relative values of the input signal being sent from earlier to harder or more difficult.

Figure 5:
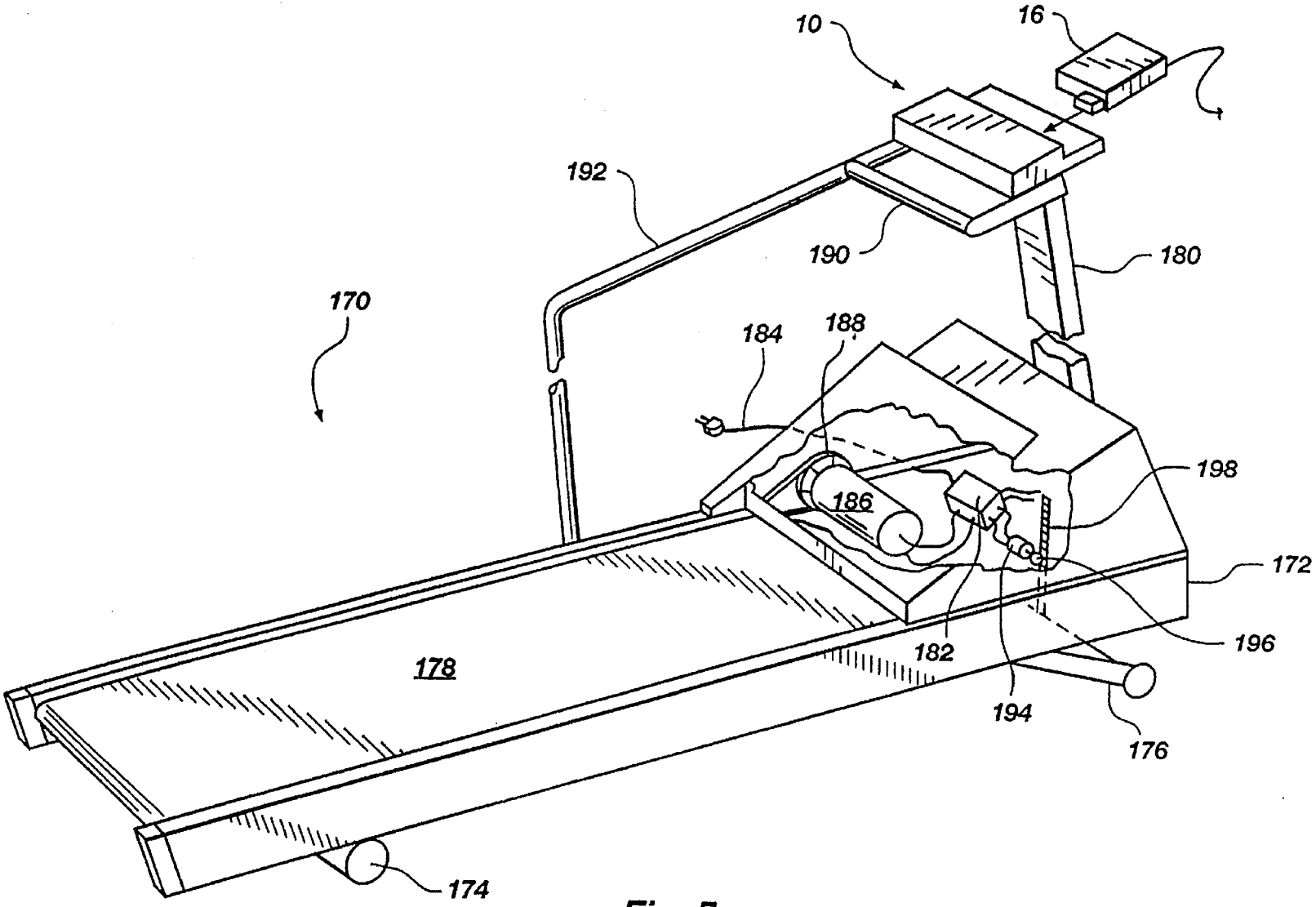
FIG. 5 is a perspective cut-away view of a treadmill with a control console having a input module connectable thereto.

Referring now to FIG. 5, a treadmill is illustrated as an example of an exercise machine of the invention. The treadmill 170 has a frame 172 and support means 174 associated therewith to support the frame on a support surface. An incline device 176 is also illustrated connected to the frame 172 to function not only as a support for the treadmill frame 172 on an underlying support surface but also to vary the incline of the frame 172 and in turn the treadmill 170 with respect to the support surface.

The treadmill 170 has a belt 178 which rotates and which is supported thereunder by structure of the treadmill so the user may walk, jog or run on the belt 178 as an exercise. More specifically, the belt 178 is a moveable element in the performance of an exercise by a user.

The treadmill 170 has a control console 10 with an input module such as input module 16. The control console 10 is attached to the treadmill 170 and more particularly to an upright post 180 connected to the frame 172. The control console 10 supplies control signals to a motor controller 182. The motor controller 182 controls electrical power received via conductor 184 from an external source to operate motor 186 which in turn drives the belt 178 via a pulley system 188. The controller 182 in association with said motor 186 operates as adjustment means adapted between the frame 172 and the moveable element which is belt 178. The controller 182 adjusts or regulates the movement of the belt 178 and in turn movement in the performance of exercise by the user of the belt 178.

The treadmill 170 of FIG. 5 also has a handle 190 and a siderail 192. The handle 190 and the siderail 192 are positioned so the user may grasp them when desired to stabilize or support the user while standing on belt 178.

It may also be noted in FIG. 5 that controller 182 supplies signals via conductors to an incline motor 194 which operates to move a pinion 196 intermeshed with a rack 198. The pinion 196 drives the rack 198 which is in turn connected to the incline structure 176. As the rack 198 moves, the incline of the treadmill 120 varies in accordance with output signals from the control console 10.

Figure 6:
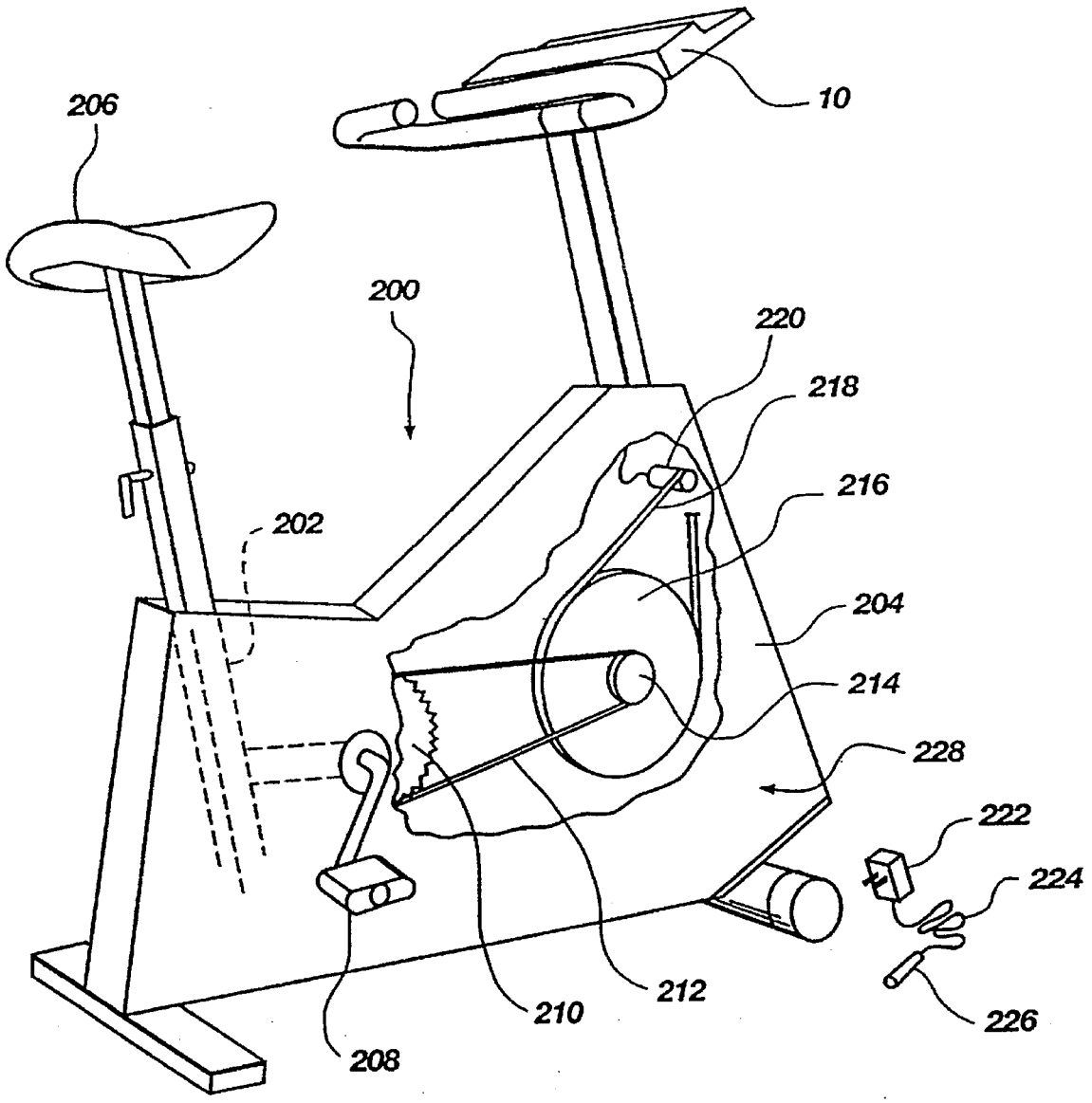
FIG. 6 is a perspective cut-away view of an exercise cycle with a chassis of a control console mounted thereto.

FIG. 6 illustrates an exercise cycle having a frame 202 shown in phantom within a protective housing 204. The cycle has a seat to support the user as the user operates the pedal mechanism 208. As shown in the cutaway, the pedal mechanism 208 operates a drive sprocket 210 which has a chain or belt 212 interconnected to drive a smaller sprocket 214 associated with an inertia wheel 216. The inertia wheel 216 has an outside race with a resistance belt 218 positioned thereabout to resist rotation of the inertia wheel 216 upon operation of the pedal system 208. The control console 10 is connected to supply control signals to a stepper motor 220 which winds or unwinds the resistance strap 218 to in turn tighten or loosen the strap 218 about the inertia wheel 216. As a result, the friction and in turn the resistance to operation of the pedal structure 208 is regulated or adjusted. Power to operate the control console 10 may be received via appropriate interior conductors from an external source of 115 volt AC via a transformer adaptor 222 and an appropriate conductor 224. The conductor 224 has a connector 226 which is sized to interconnect with an appropriate receiving connector 228 on the external housing 204 of the exercise cycle 200 of FIG. 6.

Figure 7:
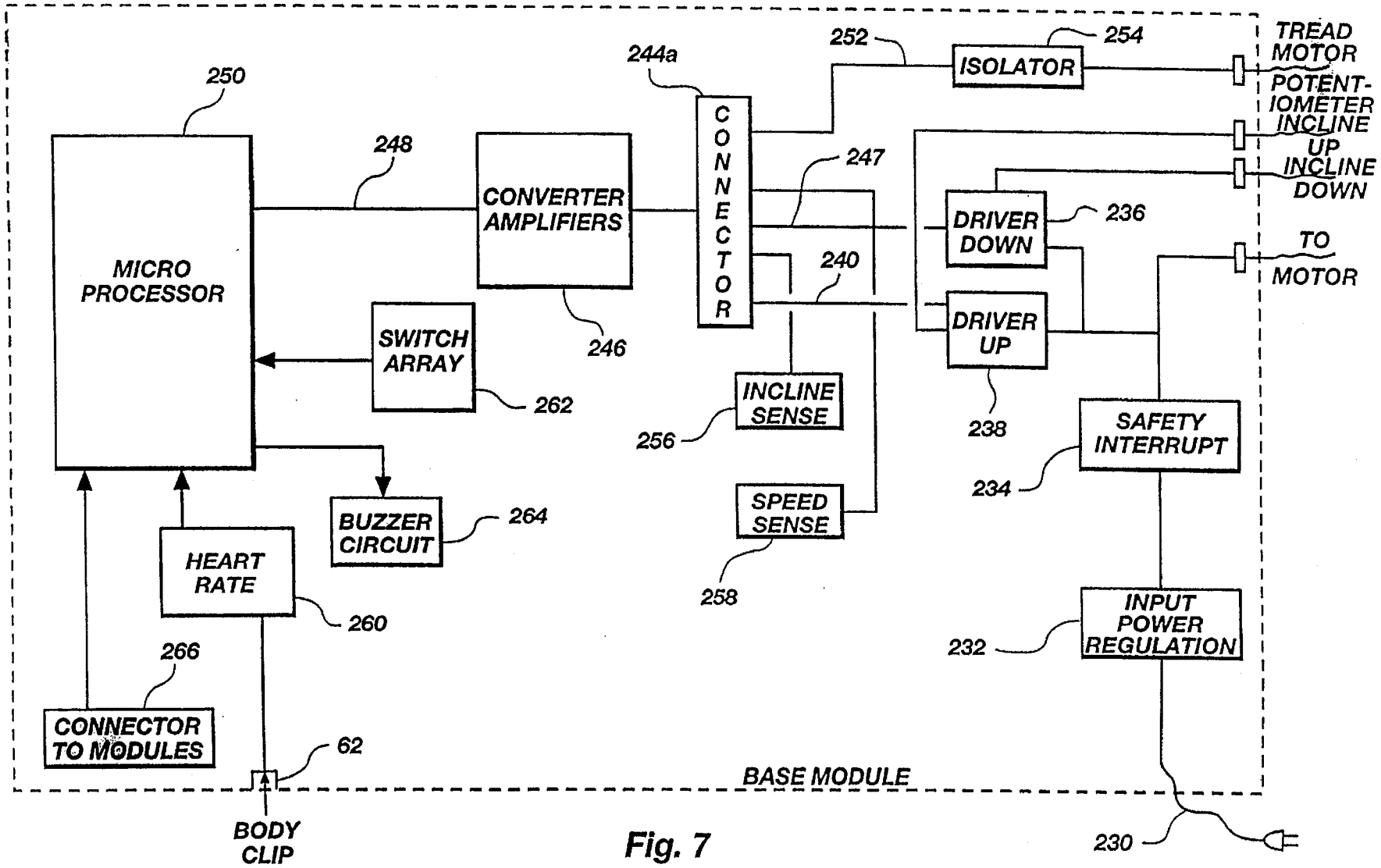
FIG. 7 is a block diagram of the base console positioned within the chassis of the control console of the invention.

FIG. 7 is a block diagram of a base module positioned within the chassis 12 of FIG. 1. The base module is here constructed of two separate circuit boards. It receives input power from an exterior source via conductor 230. The input power is received by an input power regulation circuit 232 which transmits power to an appropriate safety interrupt circuit 234 for further transmission to motor controller 182 and motor 186 of the treadmill of FIG. 5 or for further transmission to the stepper motor 220 of the exercise cycle of FIG. 6. The safety interrupt signal circuit is operated by use of the safety key 64 as discussed in FIG. 1. The input power regulation circuit 232 also supplies filtered and rectified DC power for the various electronic components of the control console 10.

Output power from the safety interrupt circuit 234 is also supplied to a pair of drivers 236 which are here connected to supply output power through the motor controller 182 of the treadmill of FIG. 5 to in turn operate the incline motor 194. Signals reflect to operate the down driver 236 and the up driver 238 are received via conductors 240 and 242 via a connector device 244*a*. Connector device 244 receives similar signals from a convertor amplifier circuit 246 which in turn receives those signals via conductor 248 from microprocessor 250. In other words, the microprocessor 250 generates control signals to cause the down driver 236 and 238 to operate and in turn cause the incline of an exercise machine such as the treadmill of FIG. 5 to vary. The microprocessor 250 also supplies control signals via conductor 248 through the convertor amplifier circuit 246 and connector 244 via conductor 252 through an isolator circuit 254 to in turn regulate the speed of the treadmill by operation of an electrical potentiometer within the motor controller 182 of FIG. 5.

The base module of FIG. 7 within the chassis 12 also has incline sensing circuits 256 which include a sensor positioned to sense the incline and in turn supply a signal reflective thereof through the incline sensing circuit and connector 244 through the convertor amplifier 246 to the microprocessor 250. Similarly, sensing circuit 258 has sensing means positioned to sense the speed (rate of movement or rate of rotation) of the belt 178 and in turn supply a signal reflective thereof via connector 244 and convertor amplifier 246 to the microprocessor 250.

The base module of FIG. 7 also shows a connector 62 to receive an input from the pulse clip. The input is supplied to a heart rate circuit 260 which in turn supplies heart rate signals to the microprocessor 250.

The base module of FIG. 7 also has a switch array circuit 262 to reflect the various switches 68, 70, 72, 74, 94, 96 and 76 operable by the user on the chassis 12. The signals from the switch array circuit 262 are transmitted to the microprocessor 250. The microprocessor 250 also supplies an output signal to a buzzer circuit 264 which sends an audible signal upon operation of any of the switches associated with the switch array circuit 262. The microprocessor 250 also receives input via any one of the three connectors 26, 28 and 30 (FIG. 1) as here shown by the module connector means 266. More specifically, input signals are transmitted from an input means such as input modules 14, 16 and 18 through the connector circuit 266 to the microprocessor 250 of the base module shown in FIG. 7. The input signals are reflective of a plurality of adjustments to the adjustment means of the related exercise machine. It may be seen clearly in FIG. 7 that the circuits here illustrated are for a treadmill of the type shown in FIG. 5.

Figure 8A:
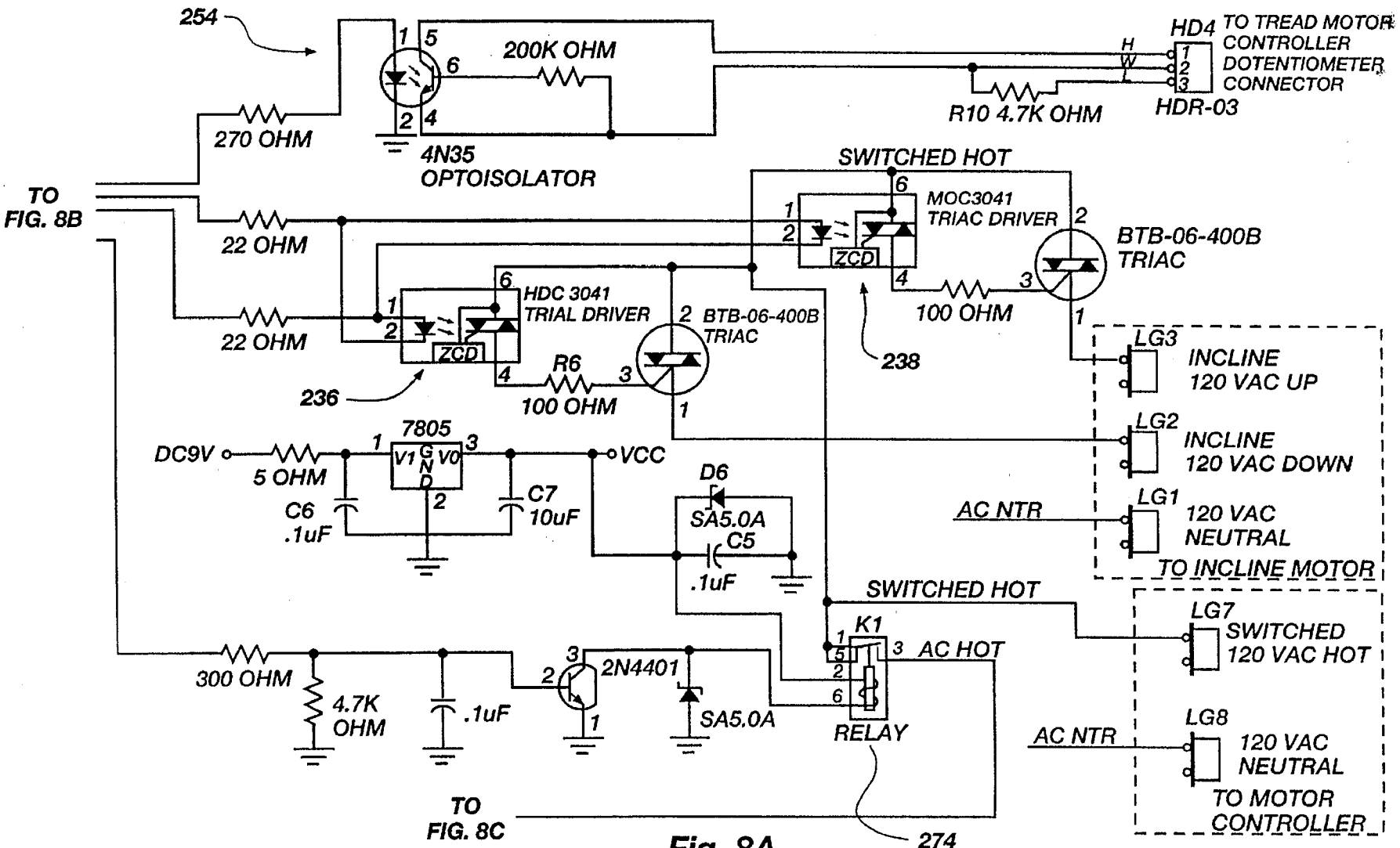
FIGS. 8A, 8B, and 8C are a construction circuit diagram of the power interface board portions of the base console of FIG. 7.
Figure 8B:
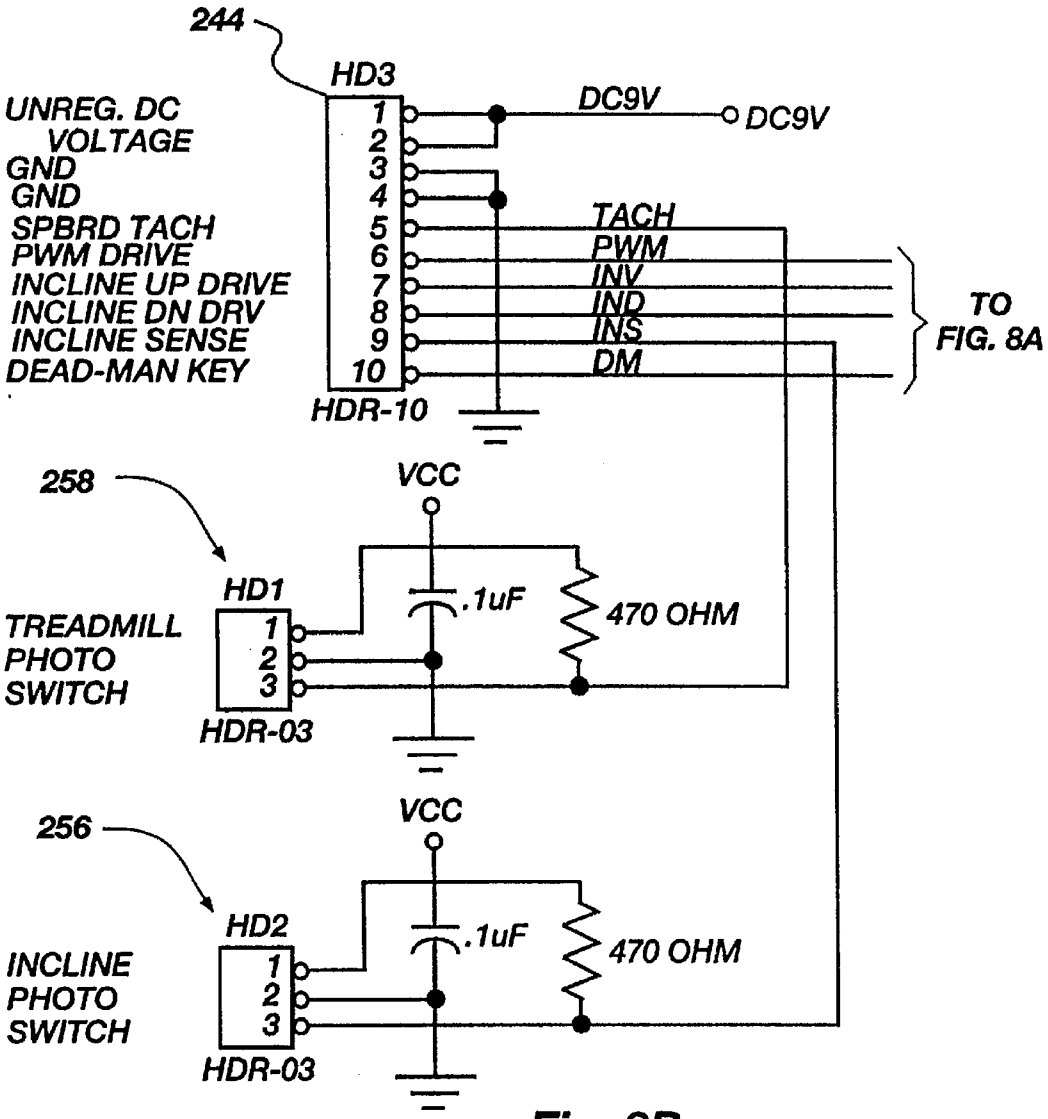
Figure 8C:
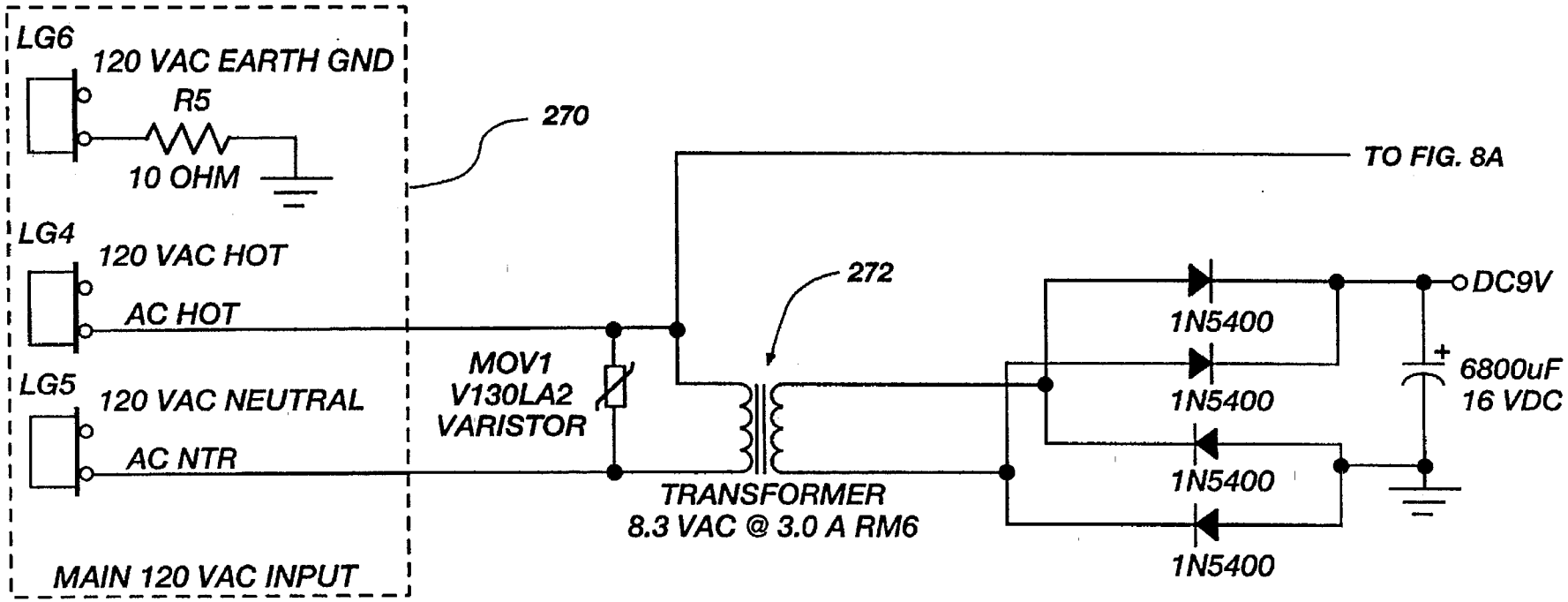
Figure 9A:
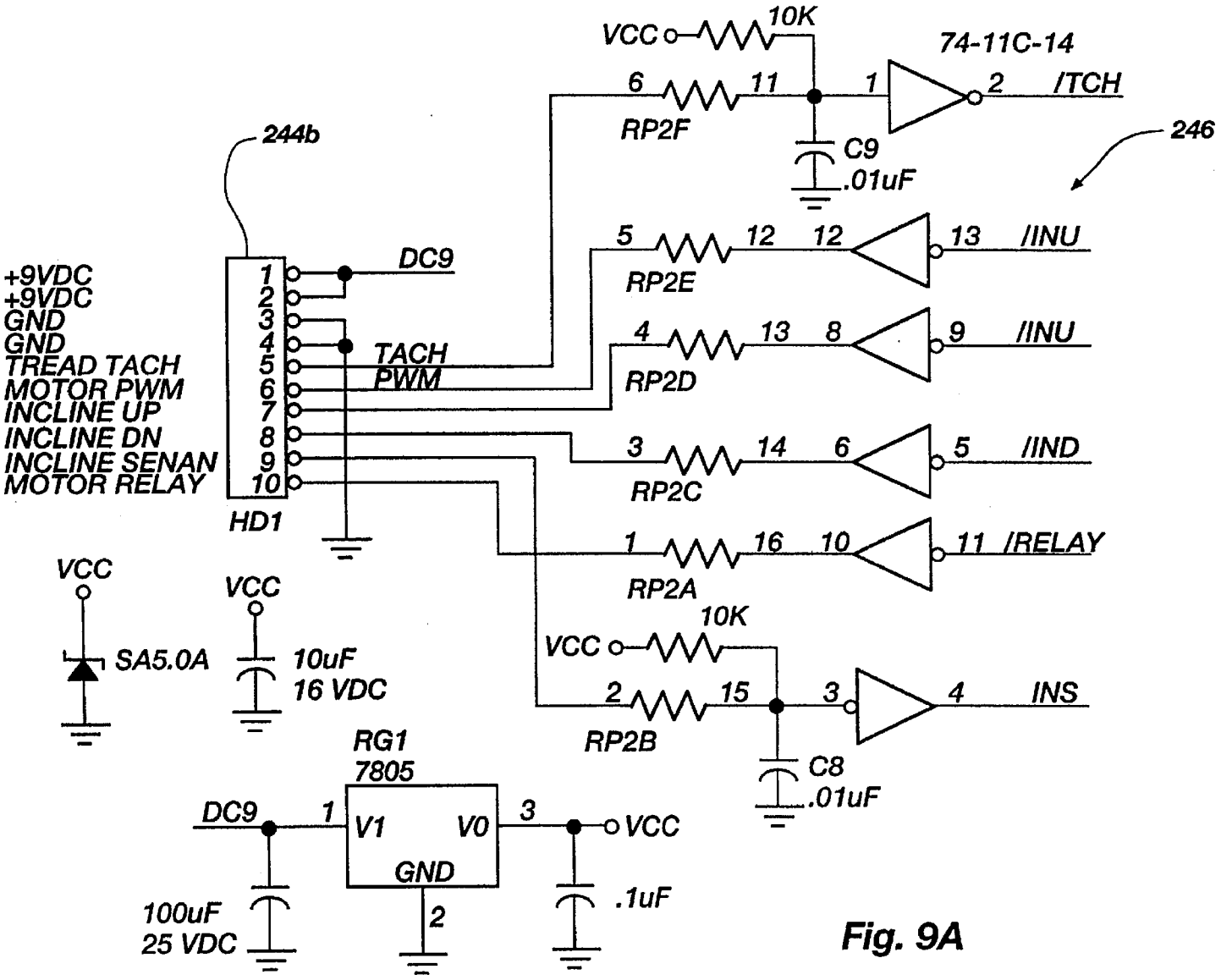
FIGS. 9A, 9B, 9C, and 9D are a construction circuit diagram of other components of the base console of FIG. 7.
Figure 9B:
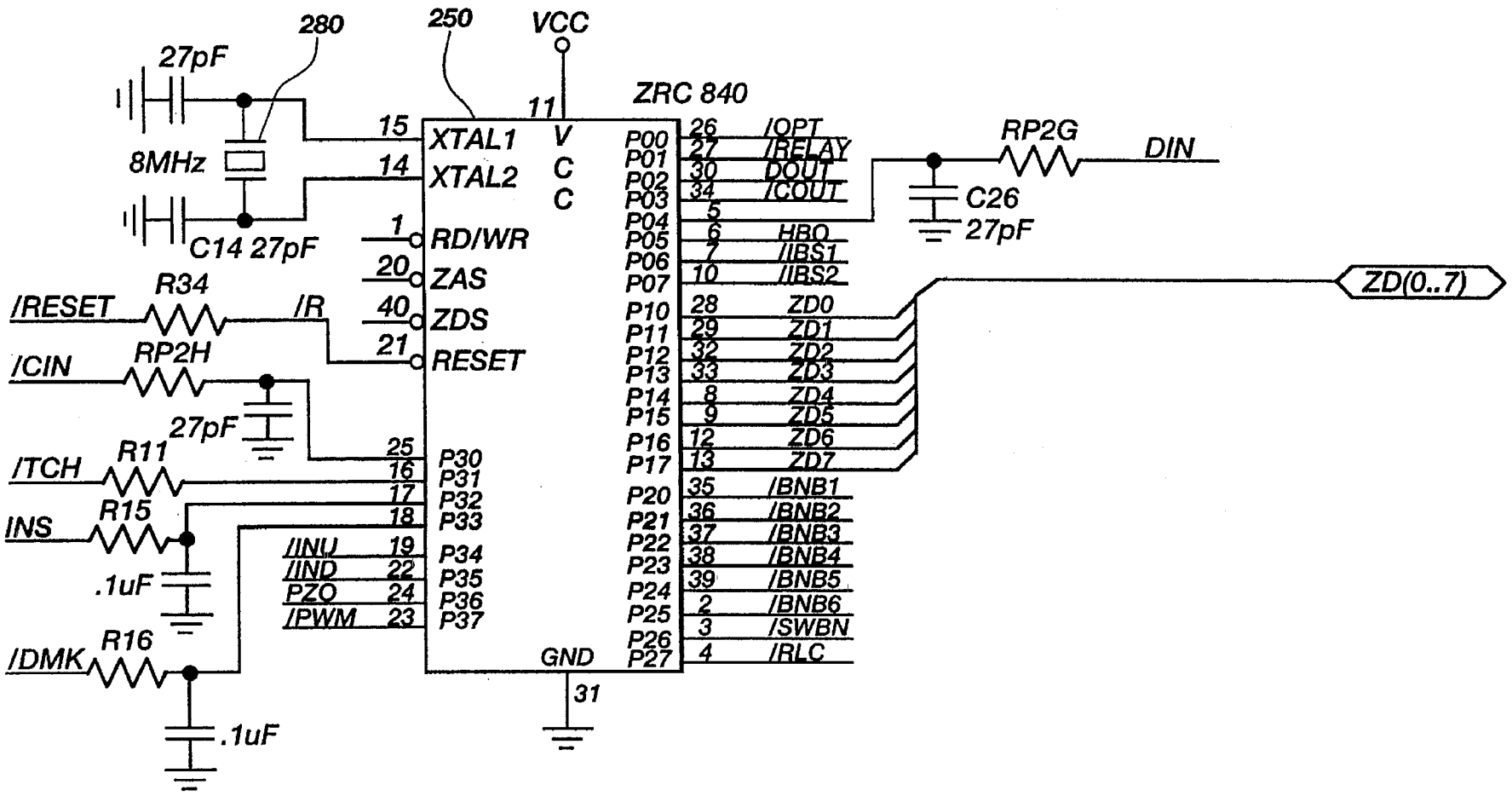
Figure 9C:
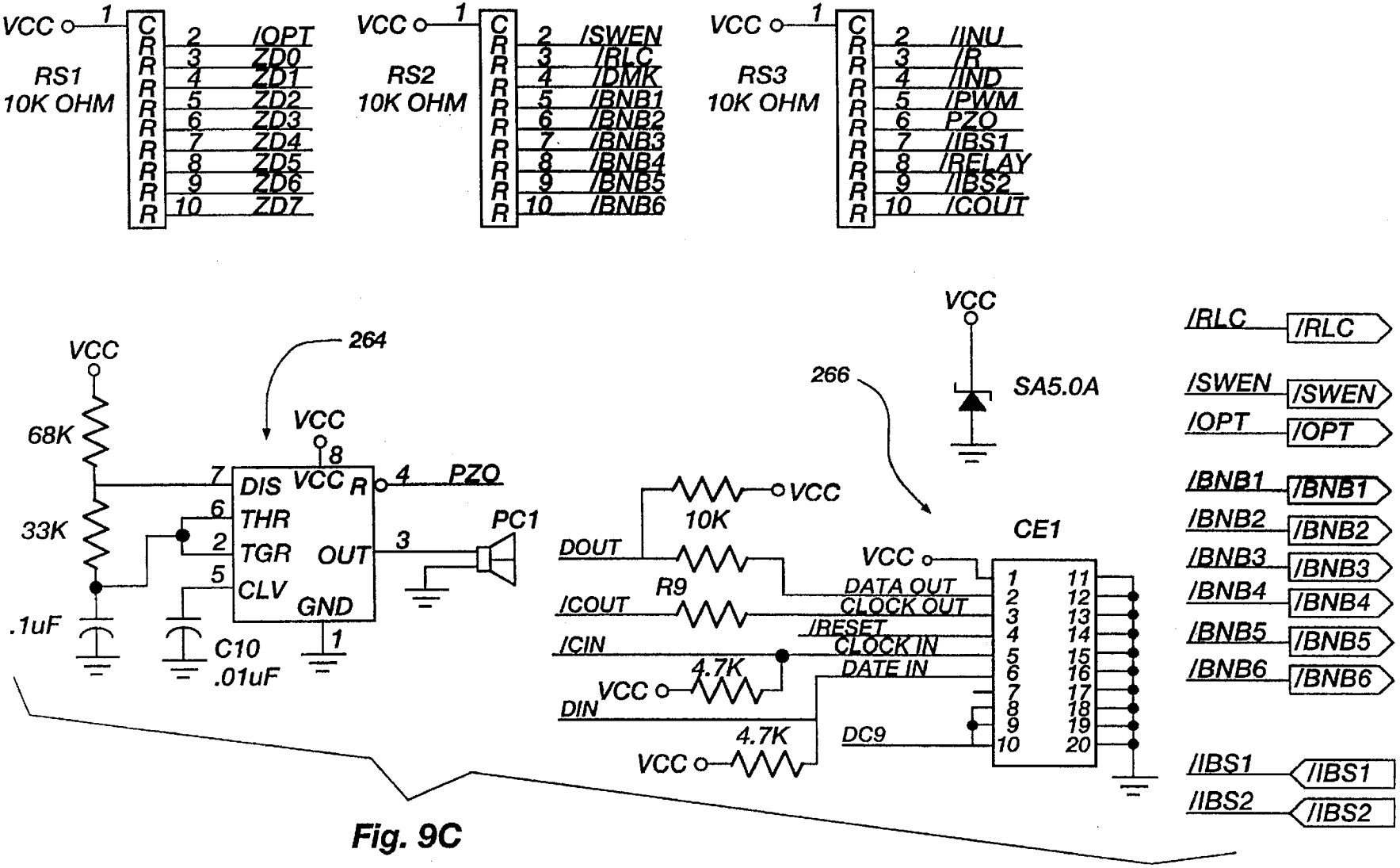
Figure 9D:
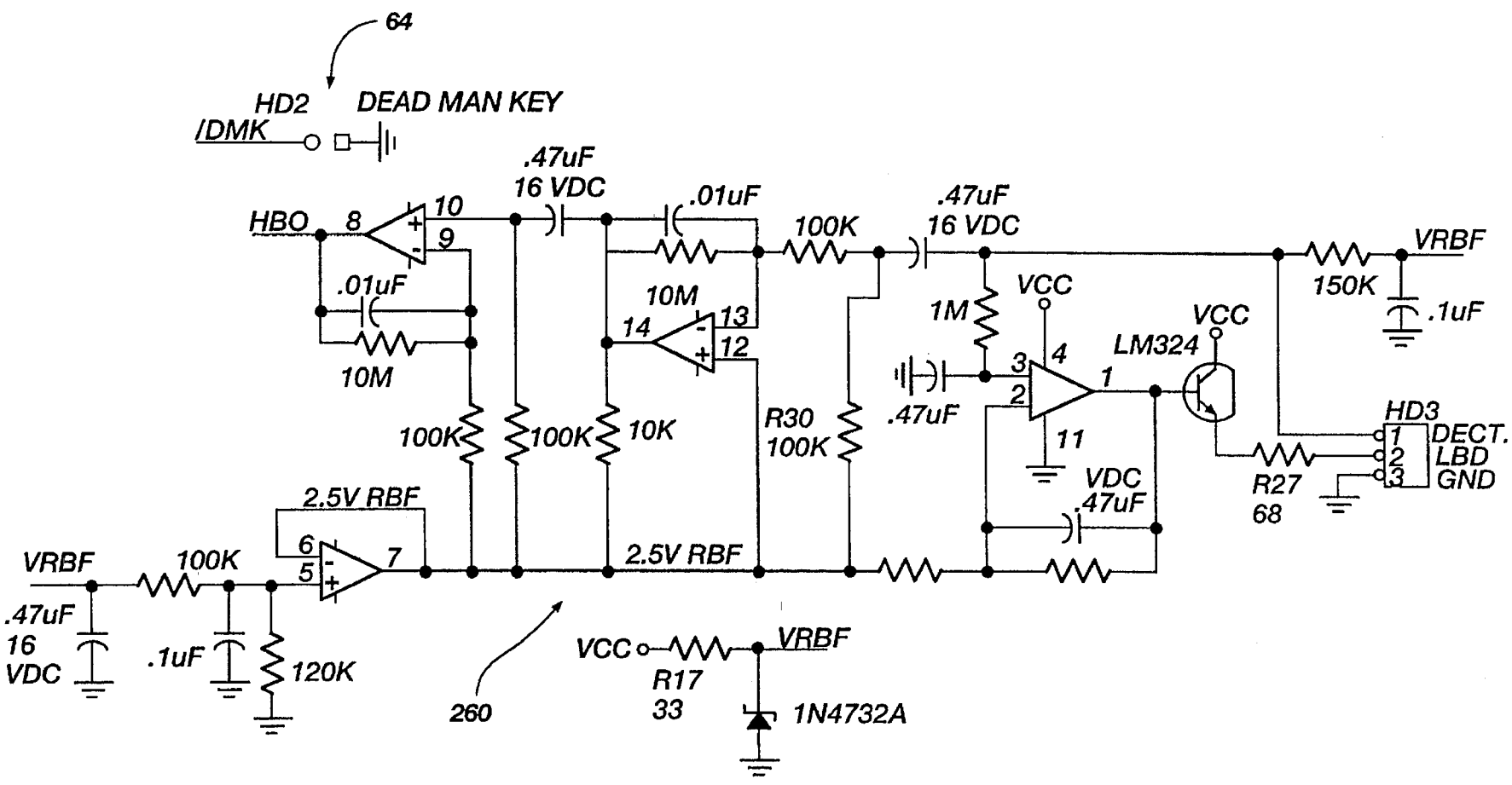

FIGS. 8A, 8B, and 8C are a construction circuit diagram of the power interface portion of the base module of FIG. 7. FIG. 8 shows the power/interface board with incline. As can be seen, input power is received via appropriate connectors 270 from an external source of 120 volt AC power. The input power is received through an isolation transformer 272 for further transmission to the relay 274. The relay is part of the safety interrupt circuit 234 and holds relay K-1 closed with the safety key or deadman key 64 inserted in the chassis 12 to thereby close the switch 235 (FIGS. 9A, 9B, 9C, and 9D).

FIGS. 9A, 9B, 9C, and 9D are another construction schematic of another portion of the base console positioned with chassis 12. FIGS. 9A, 9B, 9C, and 9D shows a switch 235 operated by key 64 as well as a heart rate circuit 260. Another connector board **244*b* is shown to reflect interconnection with components in FIGS. 8A, 8B, and 8C. The microprocessor 250 is shown with its own internal clock 280**. The converter amplifiers are also shown.

Figure 10A:
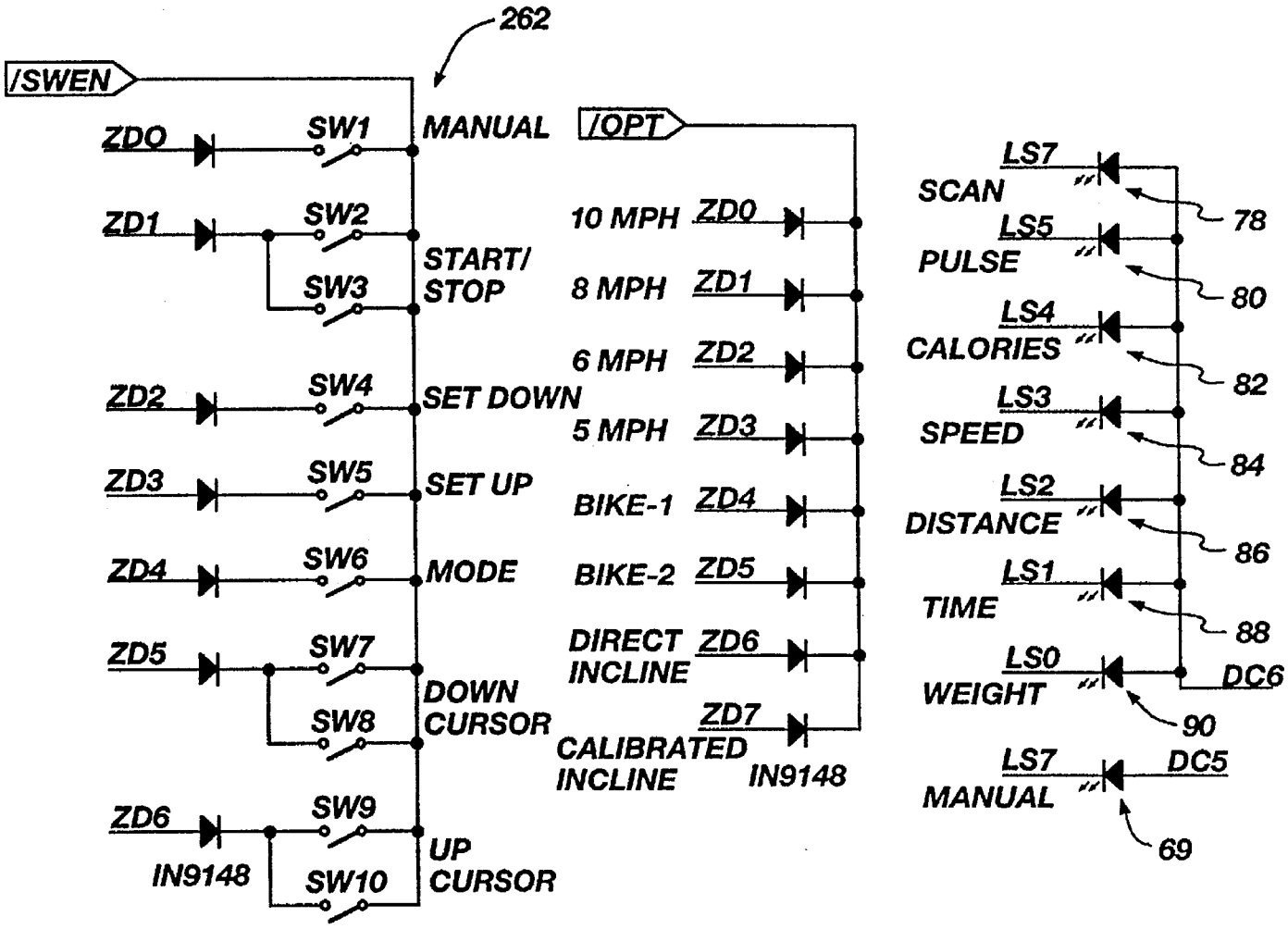
FIGS. 10A and 10B, 10C, and 10D are construction circuit diagrams of additional components of the base console of FIG. 7.
Figure 10B:
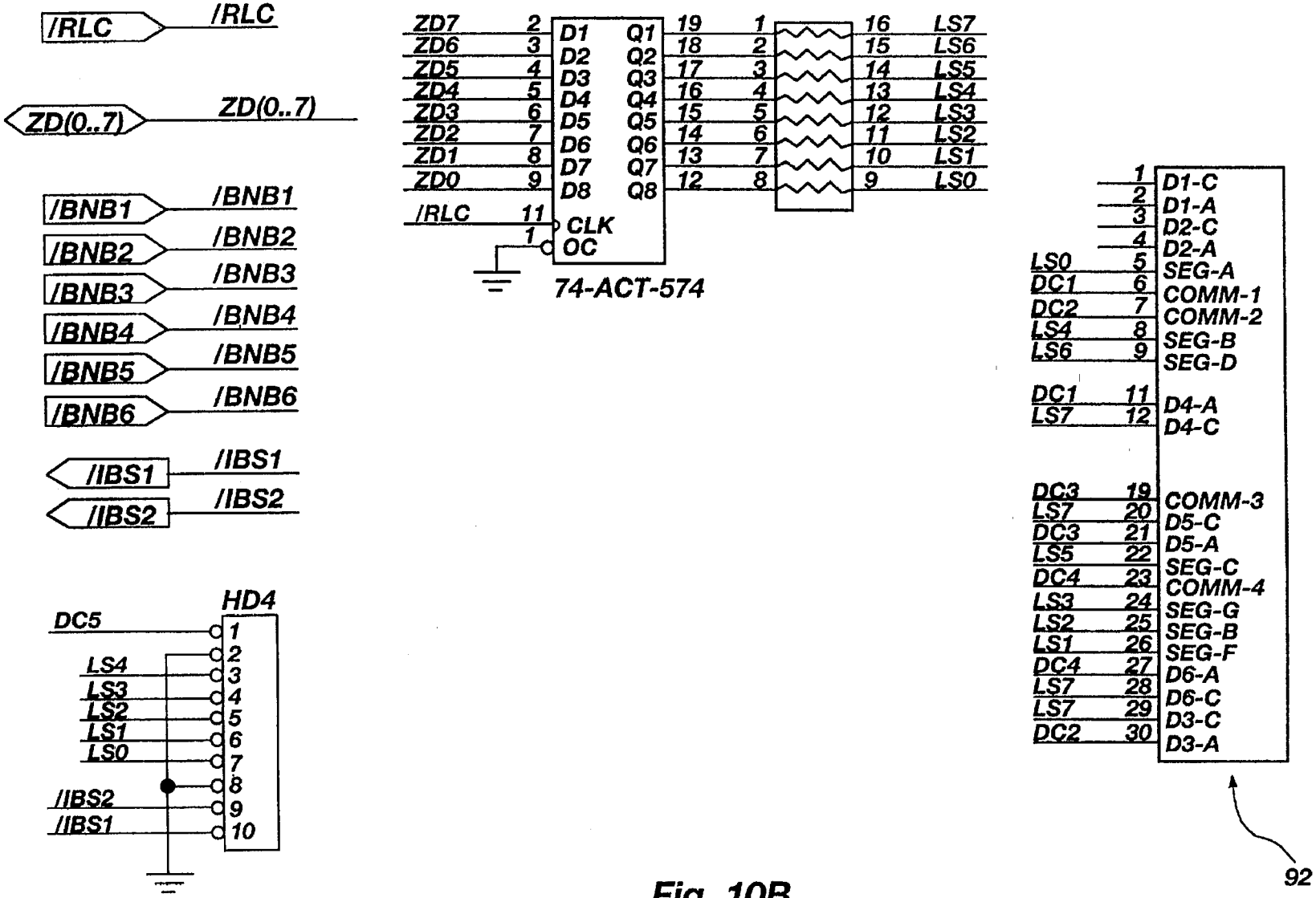
Figure 10C:
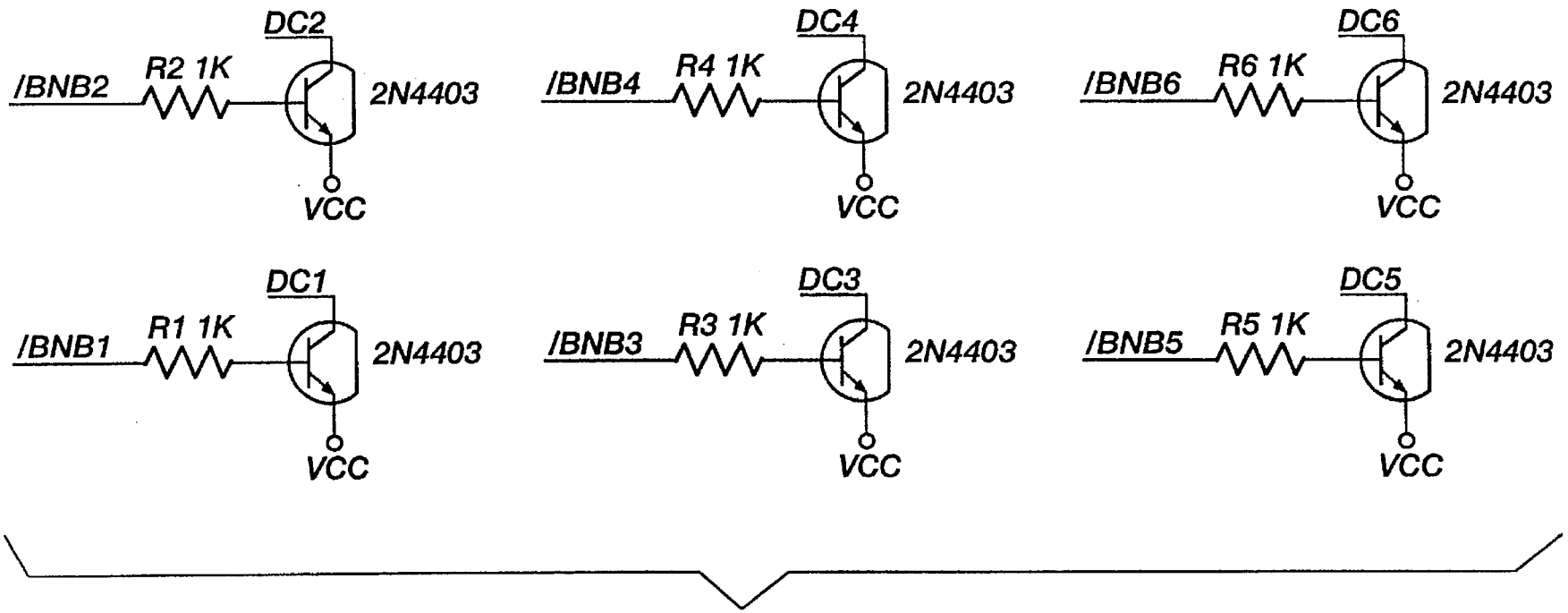

FIGS. 10A, 10B, and 10C show yet another portion of the base console which is positioned within chassis 12. Various pin interconnections are shown. The switch array 262 is shown along with the mode selection reflected by LEDs 78, 80, 82, 84, 86, 88 and 90. Also shown is the LED 69 associated with a manual switch 68 to illustrate activation in the manual mode and deactivation. The display module is also illustrated in FIGS. 10A, 10B, and 10C.

FIGS. 10A, 10B, and 10C also show an options array 263 which is a plurality of diodes as indicated. Each diode of the array 263 reflects the value of the related electrical circuit components of different types of exercise machines to which the base console and more particularly the chassis 12 may be connected. Thus, as indicated the console may be used with two different exercise cycles and treadmills having different motor speeds of 5 mph, 6 mph, 8 mph and 10 mph. Before installation of the base console and more specifically the chassis 12, the installer identifies the nature of the exercise machine. If for example, the exercise machine is a treadmill with a 6 mph motor, the diode ZD2 may be cut out and eliminated from the circuit thereby enabling the electrical connection through the 6 mph circuit to the microprocessor 250 (see pin 26, FIGS. 9A, 9B, 9C, and 9D). If the base console were to be used in association with a first model of exercise cycle then diode ZD5 would be eliminated instead of ZD2. The net result would be enable the microprocessor 250 for the machine involved. The microprocessor 250 would then identify the exercise machine with which it has been associated.

Figure 10D:
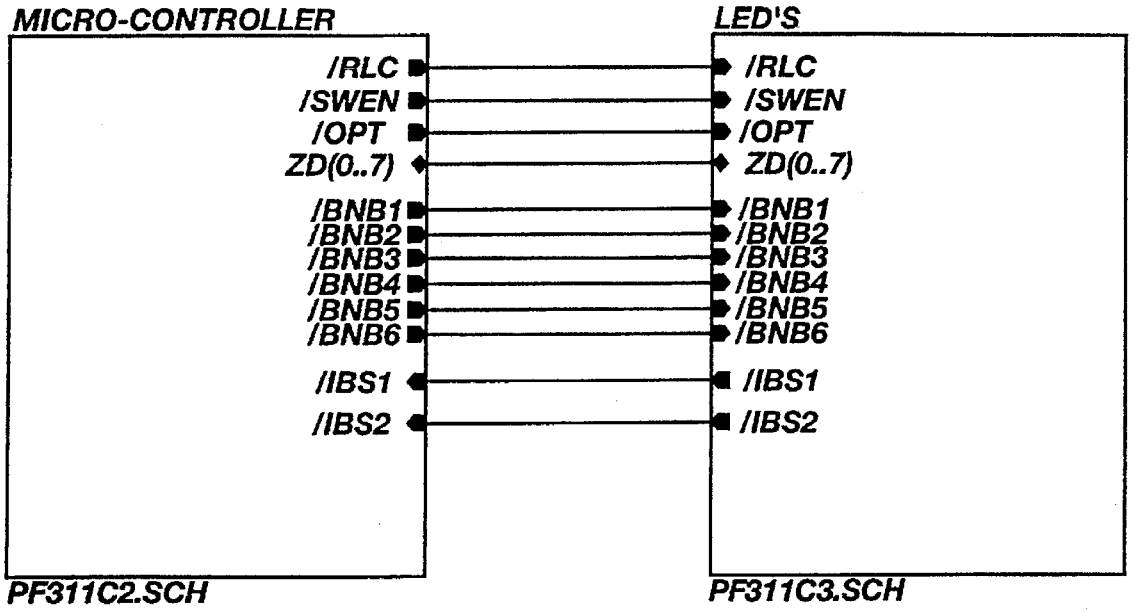
Figure 10D:
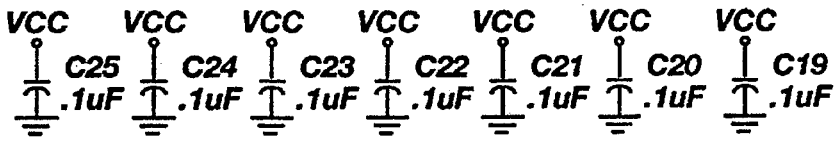

FIG. 10D shows other interconnections between portions of the circuits on the base console as may be determined from the symbology reflected thereon.

Figure 11:
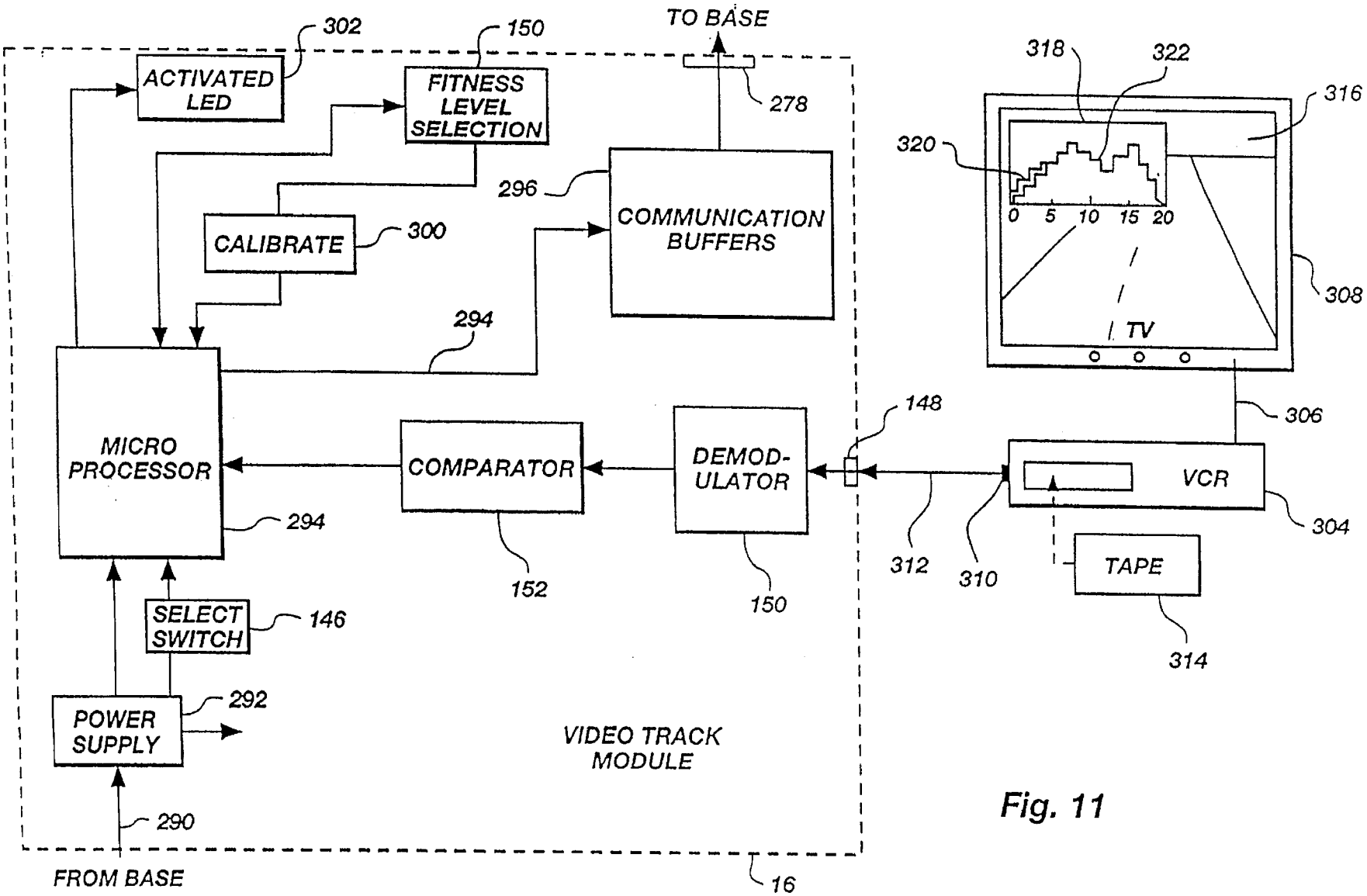
FIG. 11 is a block diagram representing the second input module of FIG. 3 interconnected with an external video system.

Referring now to FIG. 11, a second input module 16 is illustrated in block diagram format. More specifically, the module 16 receives power from the base console positioned within the chassis 12 via conductor 290. The power passes through a power supply circuit 292 for further distribution to the various electronic components throughout the module 16. Power also is supplied to the microprocessor 294 with activation being effected by select switch 146. The microprocessor 294 generates a plurality of input signals reflective of a plurality of adjustments to the movement of the moveable element of the related exercise machine. Each of the plurality of adjustments extends over a corresponding time segment, the total of the time segments equaling the full exercise period of a selected program. The input signals are transmitted via conductor 294 through communication buffers 296 and through connection means 298 to the base console in the chassis 12. The fitness level selection switch 150 is shown along with a calibration circuit 300 to calibrate the potentiometer. The microprocessor 294 is also connected to an LED 302 to reflect that the select switch 146 has been activated and in turn the module 16 has been activated.

Referring to FIG. 11, it can be seen that a VCR 304 is interconnected to supply television signals via conductor 306 to a television set 308. The VCR is also connected to supply audio signals via audio jack 310 and cable 312 to the video track module 16 and more specifically, the video jack 148. The signal from the video jack 148 is supplied to a demodulator 150 which supplies the demodulated output signal to a comparator 152 which in turn supplies signals to the microprocessor 294.

In operation, video tape 314 is inserted into the VCR 304 which is operated in a conventional fashion. The tape 314 has an audio channel to supply an audible signal in a normal fashion. On the audio channel, periodic audio signals constituting exercise signals are positioned and extracted by the VCR and transmitted via conductor 312 to the demodulator 150. The audio signals translate to external control signals which are received by the input module 16 and supplied to the microprocessor. The microprocessor in turn supplies input signals reflective of the external control signals received via conductor 312.

The tape 314 also has a video channel. The VCR extracts a first video signal to which is transmitted via cable 306 to the television 308. To present a video image as illustrated on the screen 316 of the television 308. The images illustrated reflects a road, mountain, hill or other similar terrain feature consistent with and related to the plurality of adjustments and more specifically the adjustment then being transmitted as an external control signal through the demodulator 150 and comparator 152 to the microprocessor 294 and in turn as an input signal through the communication buffer 296 to the base unit and in turn the adjustment means of the related exercise machine. Thus, a user would experience some increased level of difficulty when one observes a hill.

The video track of the tape also contains a second video signal which is extracted by the VCR 304 and transmitted via cable 306 to the television 308 in order to present on the screen 316 a separate phantom image 318 superimposed over the normal video image as depicted. The phantom image 318 illustrates the various adjustments in a vertical scale as they occur in their related associated time segments on a horizontal scale. Thus, the user is presented with a visual image of the relative level of the adjustments of the adjustment means of the exercise machine during the performance of exercises.

The tape 314 also has a third video signal which is extracted by the VCR 304 and supplied via cable 306 to the television 308 to show movement of the tape and in turn completion of corresponding time segments or portions thereof. Completion of related of time segments is reflected here by showing a double image 320. In application, it has been found that a color television 308 may be preferable so that the line 322 reflecting the separate adjustment level in each time segment may change color from, for example, a dark color to a light or white color. Thus, the user is visually informed of the progress of time through the exercise program depicted 318. As the user progresses through the exercise program and that progress is illustrated 320, the corresponding external control signals being supplied to the module 16 correlate to the input signals being transmitted through the communication buffers 296 to the base unit and in turn to the adjustment means of the related exercise machine as modified by the fitness level selection switch 150.

From the arrangement shown in FIG. 11, it can be seen that any number of different tapes 314 may be provided to supply a plurality of external control signals correlating to a separate and unique plurality of input signals. In turn, the video signals being supplied will also reflect the adjustment levels and visually indicate the adjustment level to the user.

It may be noted that the external control signals being supplied from the VCR 304 to the module 16 are preferably audio signals supplied from the audio jack 310. The audio signals appear on the audio track of each tape 314 and will be heard by the user. Data is transmitted using a 2 khz sign wave toneburst of 10 milliseconds in duration to represent a binary 1. A no-tone lasting for a duration of 10 milliseconds represents a binary 0. Thus, binary signals can be transmitted from the audio track of the tape 314 to the module 16.

In operation it has been found that a single audio data packet may be used containing among other items 32 unique values representing speed (only 29 values are currently used: 0–28) and 8 unique values representing incline level for a treadmill exercise machine. Such a data structure requires 8 data bits (1 byte), 5 for speed and 3 for incline. The entire data packet incorporates a start bit, 8 data bits, and 7 parody bits. Thus, there is a total of 16 bits employed. Between each data packet, no-tones (binary 0) are transmitted for 100 milliseconds or 10 bits in duration. This allows the microprocessor 294 of module 16 to detect and get into synchronization with the incoming data stream without regard to positional information within the data stream. Data in turn is transmitted in bursts of 4 consecutive identical packets between sections of for example, music or other audible tones. A minimum silence of approximately 0.5 seconds proceeds each packet burst. The demodulator 150 receives the signal. The demodulator includes a peak detector which senses the presence of a tone or music and outputs a logic level 1 when a tone is present and a logic level 0 when a tone or music is not present.

Data is received by a peak detector which senses the pressure of a tone or music and outputs a "1" with a tone and a 0 when music or no-tone is present. The data is received by the demodulator in the time domain as illustrated by the 16 bit signal appearing in Table 1 appearing in FIG. 22. Table 2 appearing in FIG. 23 shows various packet data bit descriptions and their value.

Four identical data packets are recorded on and spaced apart on the audio track of the video tape 314. Two error free data packets must be received before an adjustment is made in, for example, speed or incline. To detect an error, all parity and exclusive "OR" bits must be evaluated upon the reception of the packet by the demodulator. This particular parity scheme lends itself to error correction by examining the data in matrix form.

As shown in Table 3 appearing in FIG. 24, the data is evaluated by the demodulator in column and row format. For example, assume that a parity error were detected in column 2 upon examination of parity bit 2. This error indicates that one of the bits in column 2 is in error. Upon examination of the exclusive "OR" bits, it is found that row 4 indicates an error. Given this row and column error information, the bit at fault can be identified as bit D O. By simply inverting the received bit value of D O, the error can be corrected; and the matrix parity is accurate. This detection method is suitable for single, double and triple bit errors. However, the method can fail under certain error conditions. To provide extremely accurate data to the exercise equipment user, the microprocessor 294 requires two identical packets to be received without any parity/XOR errors before updating the input signal being transmitted by the input module 16.

Table 4 appearing in FIG. 25 sets forth factors which may be applied in order to develop the appropriate software to use in the selected microprocessor 294 of the module 16.

Figure 12A:
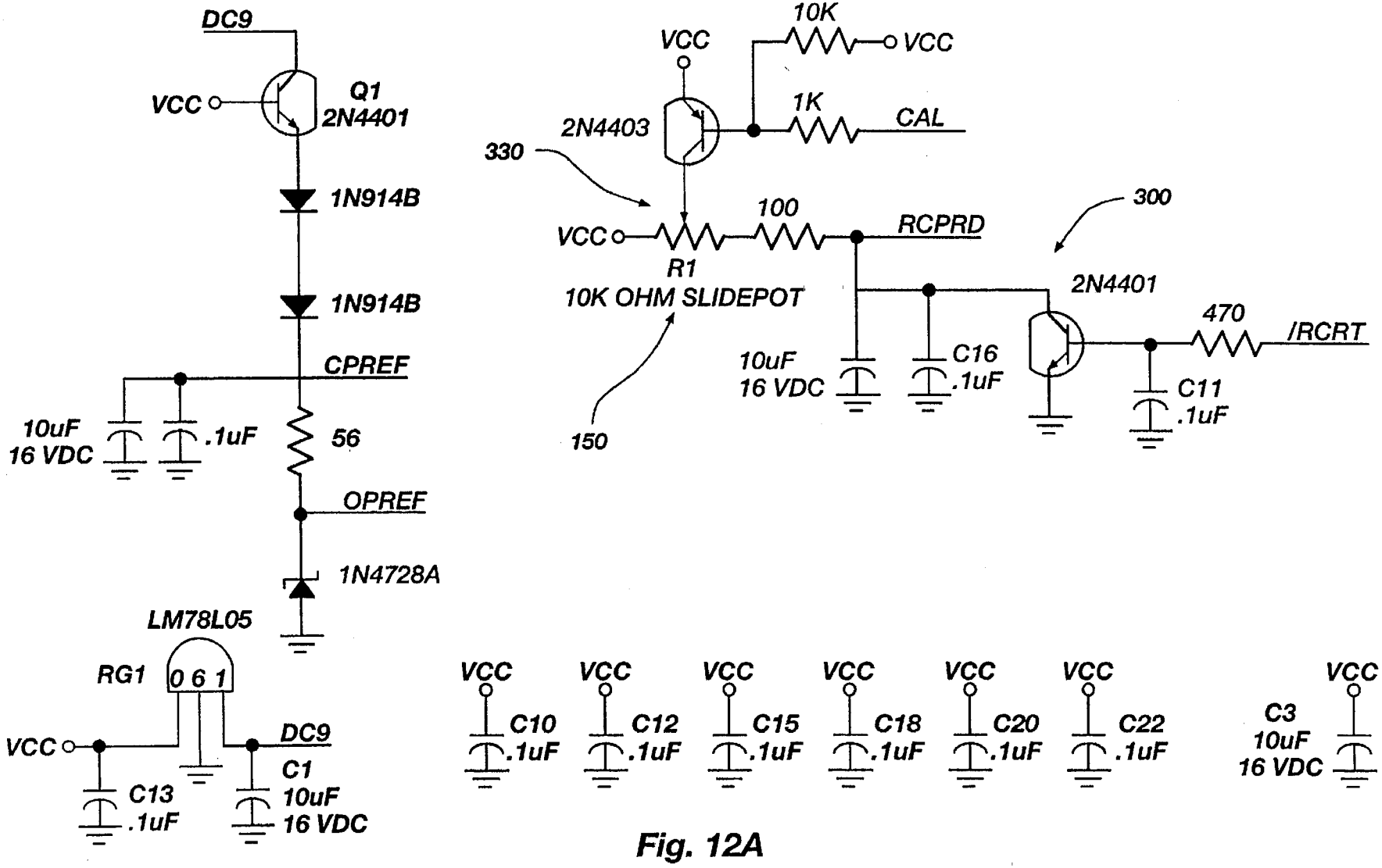
FIGS. 12A, 12B, and 12C are a construction circuit diagram of a video track module of FIG. 11.
Figure 12B:
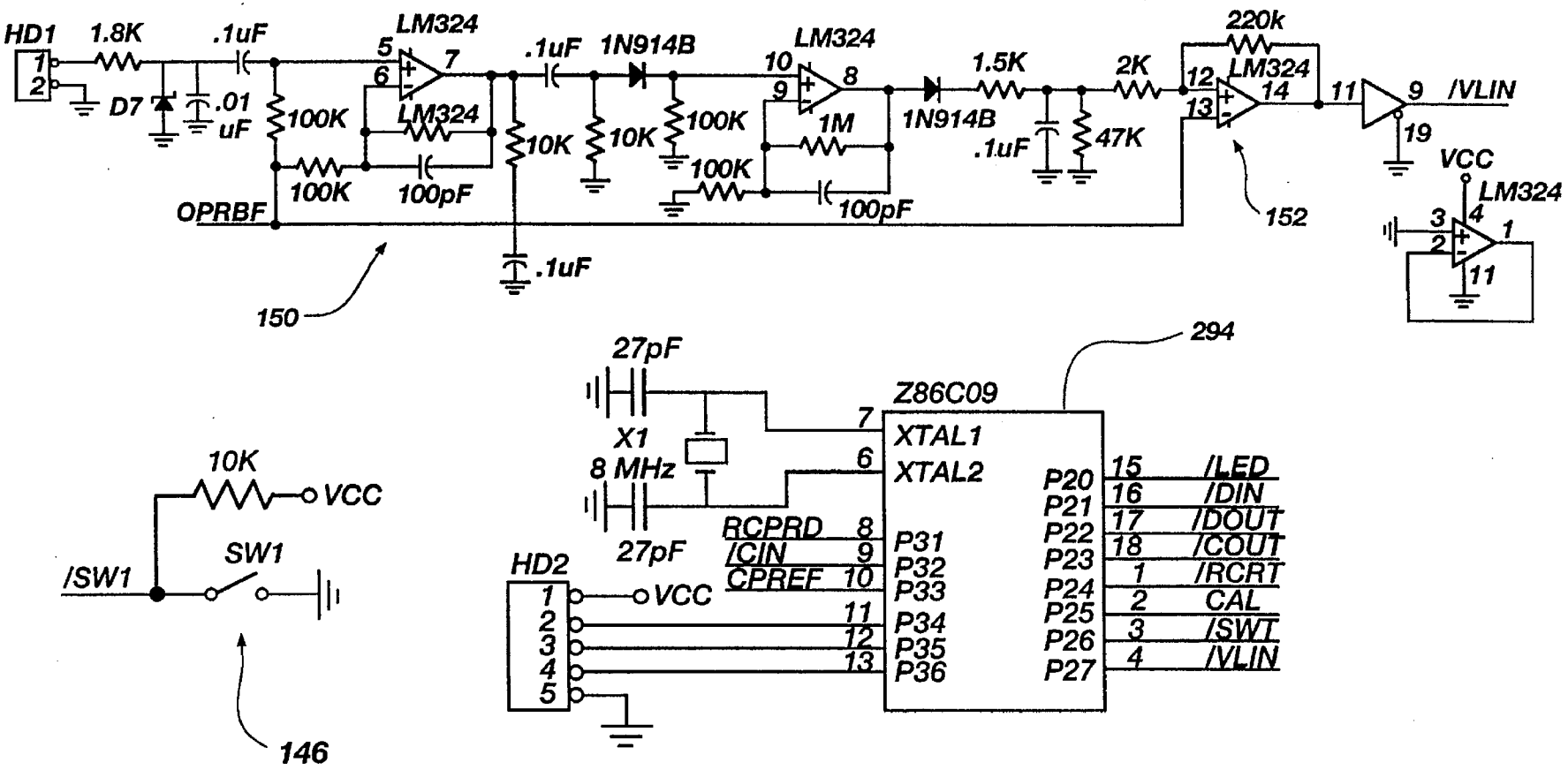
Figure 12C:
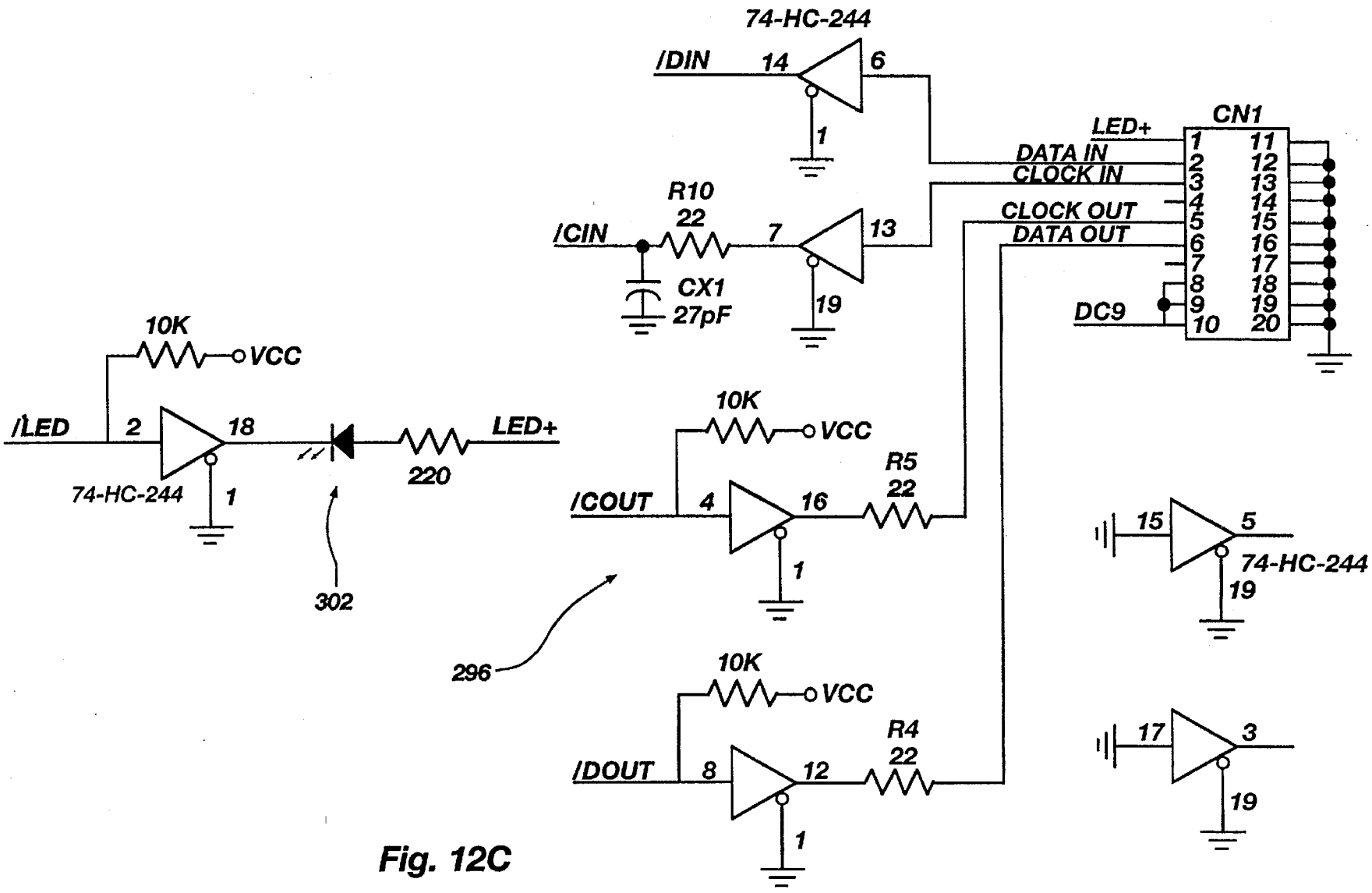

FIGS. 12A, 12B, and 12C are a construction diagram of the module 16 illustrating the various components thereof including specifically the fitness level selection switch 150 and its related variable resistor 330.

Figure 13:
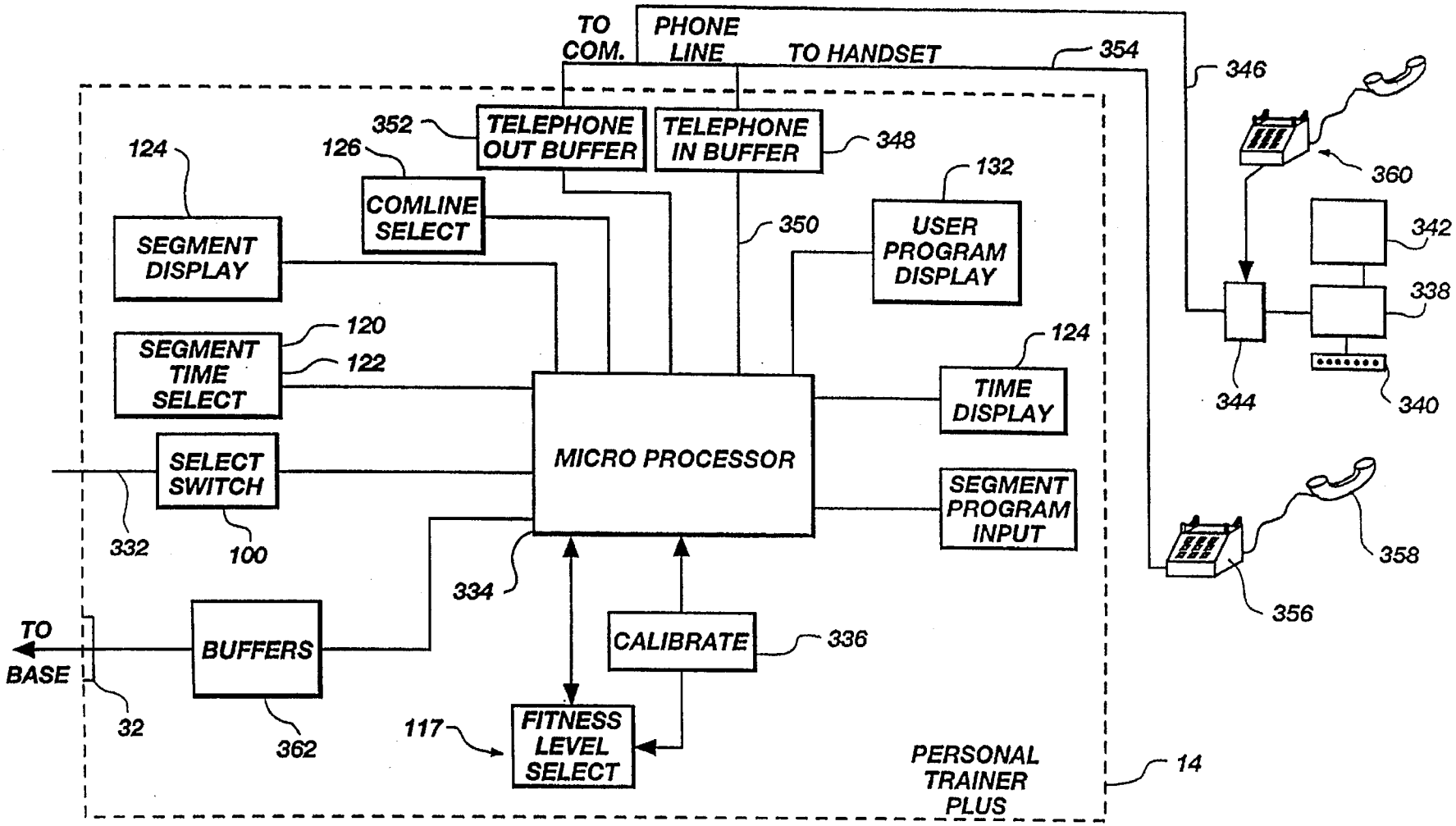
FIG. 13 is a block diagram of a first input module of FIG. 2 interconnected with an external source.

FIG. 13 shows the second input module 14 here identified as a personal trainer plus module. The module receives input power from an external source via conductor 332. The power is processed through select switch 100 for further transmission to a microprocessor 334. The module 14 has a fitness level select switch 117 along with a calibrate circuit 336. The module 14 also has a COMLINE select switch 126 interconnected with the microprocessor 334 to select the interconnection with an external source to receive external control signals therefrom and also to supply output signals thereto.

The external source illustrated in FIG. 13 is a computer 338 having an input keyboard 340 and a related visible monitor 342 interconnected via transmission means 344 including a modem via a conventional telephone system and telephone line 346 to a modem in buffer 348. External control signals can thereby be sent to regulate the input signals being transmitted via buffer 362 to the microprocessor 334 via conductor 350.

Output signals are also supplied from the microprocessor 334 via the output buffer and modem 352 and the phone line 346 back to the computer 338. The conductor 354 is also interconnected to one line 246 and a standard telephone 356 which is associated with a handset 358. In use, the operator of the computer 338 may also have a separate telephone set or handset 360 and engage in voice communications with the user who uses handset 358. The voice communications can now be interrupted so that computer data can be exchanged between the microprocessor 334 and the computer 338. In this manner, the user of the exercise machine may inform an external individual of the progress of the user in performing exercises and receive specifically designed external control signals reflective of a uniquely designed program for insertion into the microprocessor 334 for further transmission through buffer 362 and connector 32 to the base console in the chassis 12.

The input module 14 also has a user programmed display which includes the LED array 132. The user programmed display is connected to the microprocessor 334 for operation by the microprocessor. The module 14 also has a segment display 124 along with segment time select switches 120 and 122 which are incorporated into the time select circuit for supplying signals to the microprocessor. Similarly, the personal trainer plus circuit has a segment program input which includes operational switches 138 through 142.

FIGS. 14A, 14B, 14C, 14D, 14E, and 14F are construction drawings showing practical circuits containing the various elements shown in FIG. 13. The S and R inputs to the flip-flops are grounded.

Figure 15:
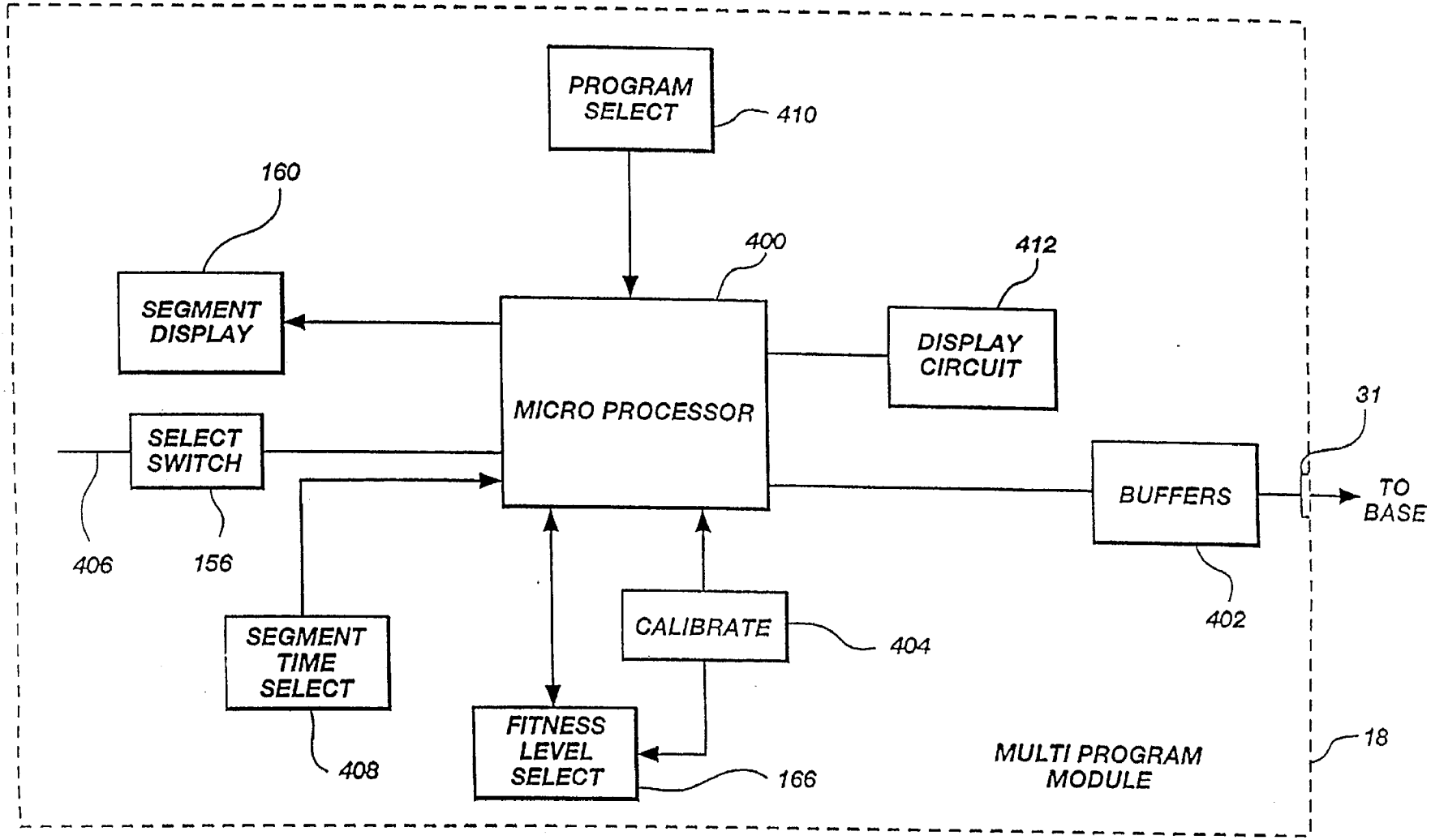
FIG. 15 is a block diagram of the third input module of FIG. 4 for connection to the chassis of FIG. 1.

FIG. 15 shows a block diagram of a multi-program module which may also be known as a Track 5 module 18. The multi-program module has a microprocessor 400 which supplies input signals reflective of a plurality of adjustments to the adjustment means of the related exercise machine via the buffers 402 and connector 36 to the base console which is positioned in the chassis 12. The input module 18 also has a fitness level select switch 166 interconnected to the microprocessor to vary the input signals similar to the fitness level select switches 150 and 117. The input module 18 also has a calibrate circuit 404 for calibrating the fitness level select switch 166. The module 18 also receives power from an external source via input conductor 406 through the select switch 156 in order to activate the entire module 18. The module also has a segment display 160 as well as controls which include the switches 162 and 164 here shown by the time select circuit 408. The select switch 156 may also be operated and in turn function as a program select switch 410 in order to vary between a plurality of programs stored in the microprocessor 400 for further transmission as input signals to the base console in the chassis 12. The microprocessor 400 also supplies signals to a display circuit 412 which specifically includes the LEDs 160 through 164.

Figure 14A:
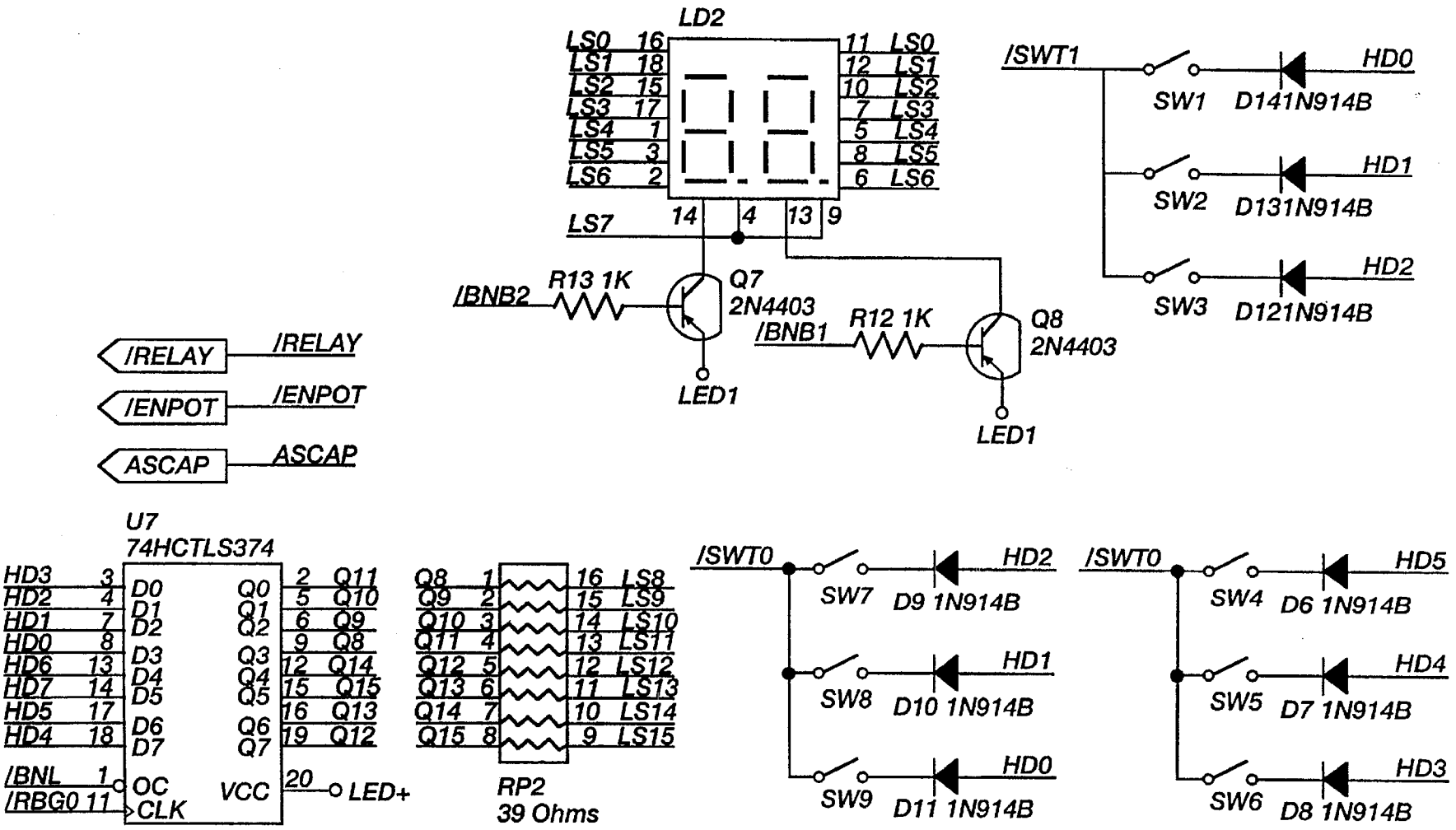
Figure 14B:
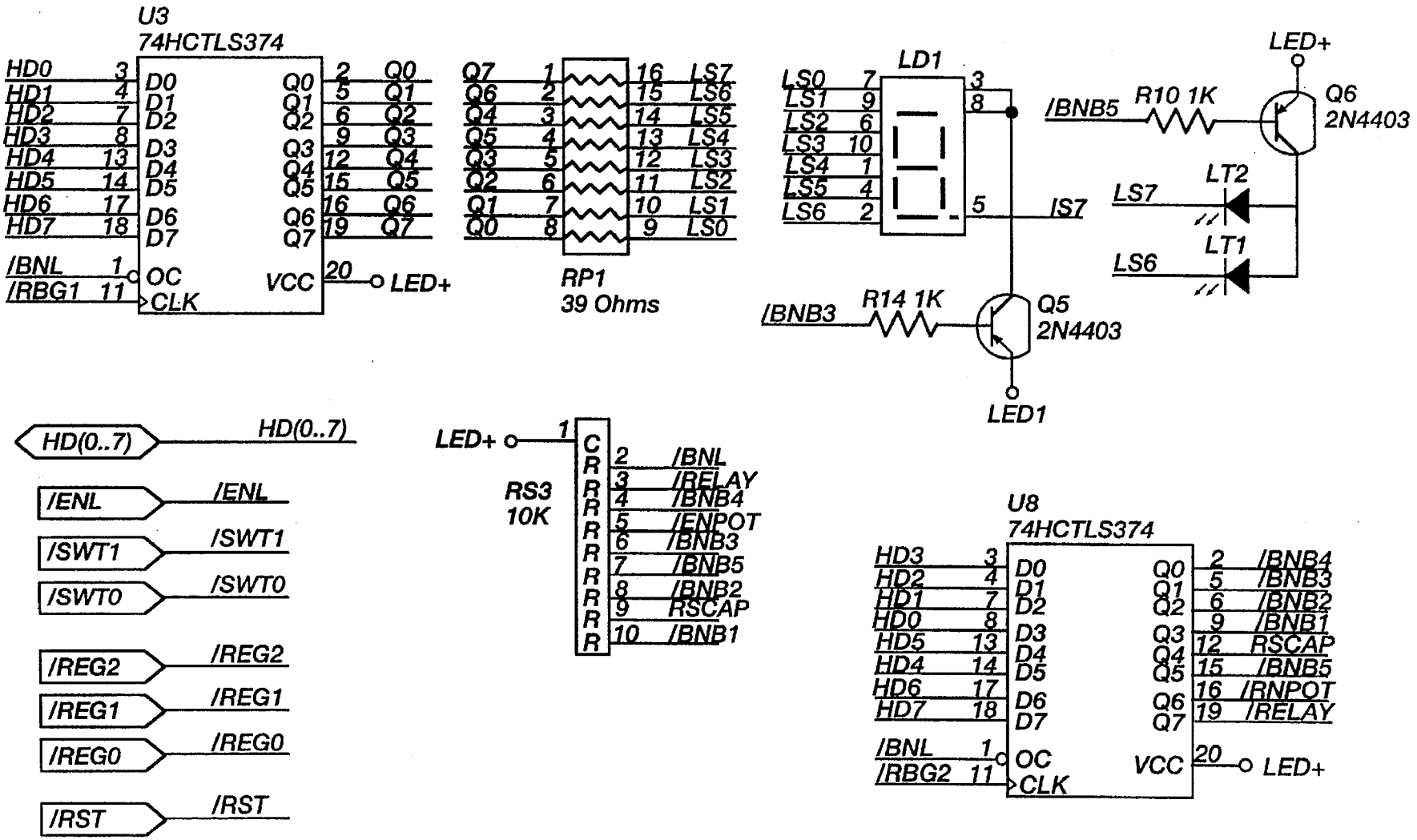
Figure 14C:
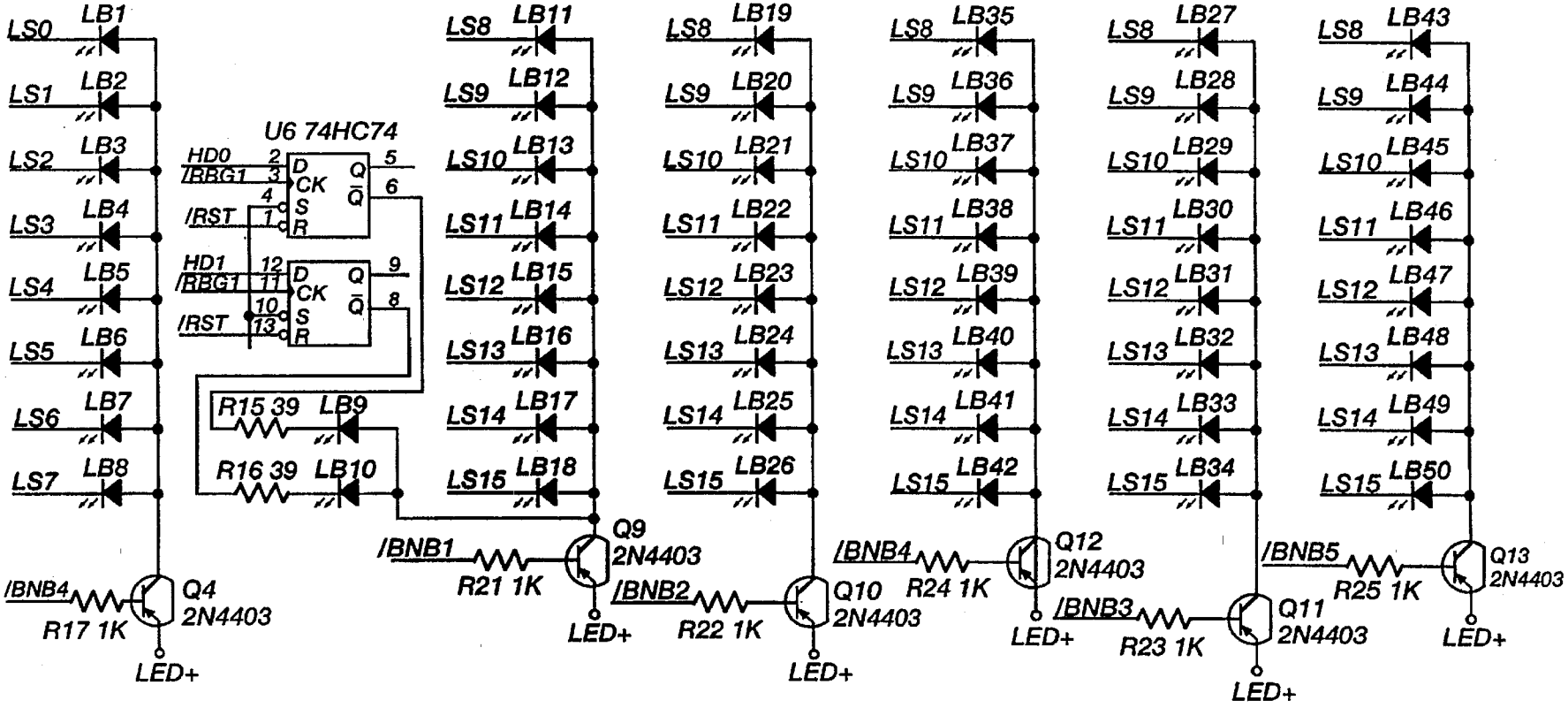
Figure 14D:
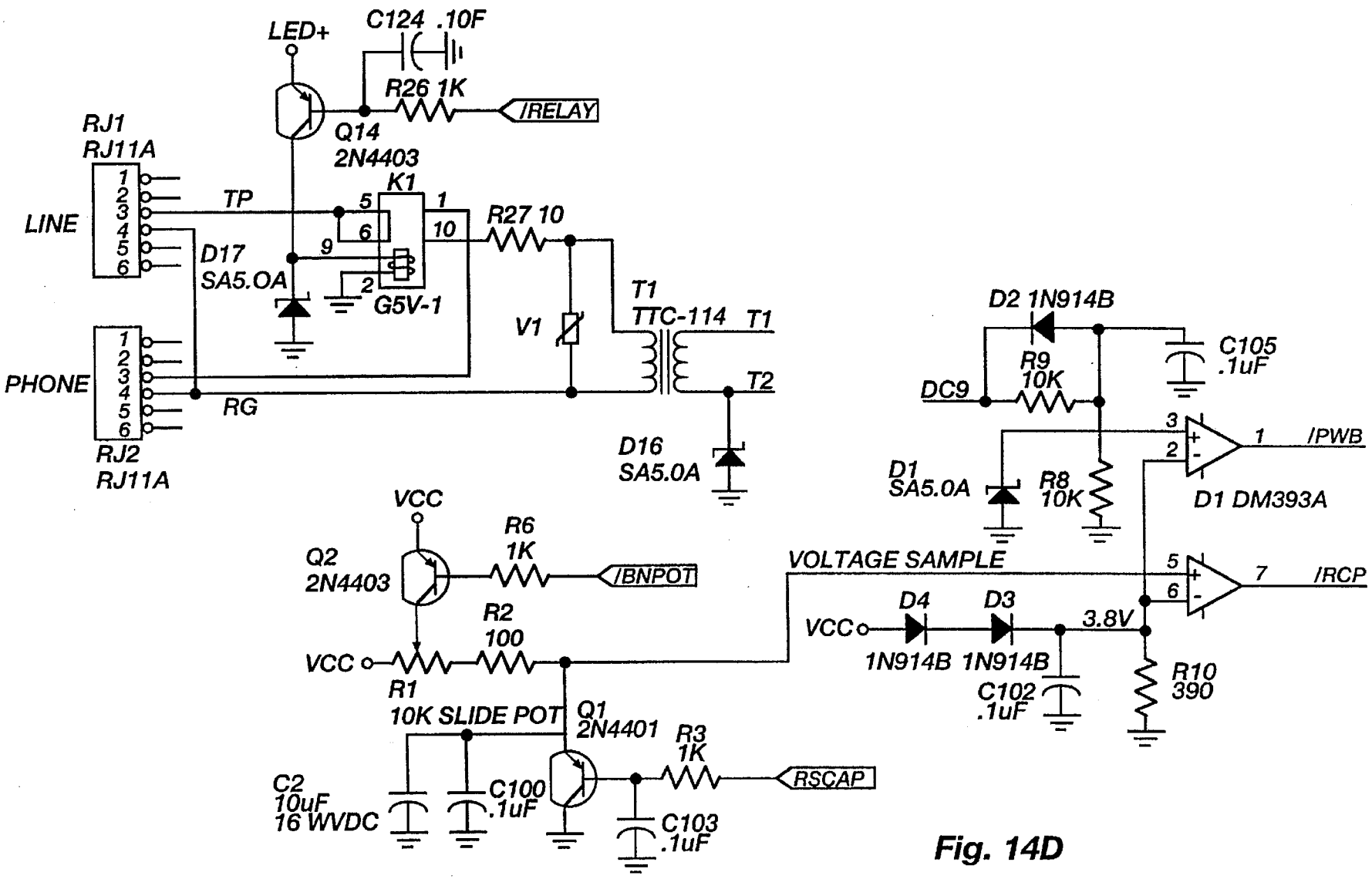
Figure 14E:
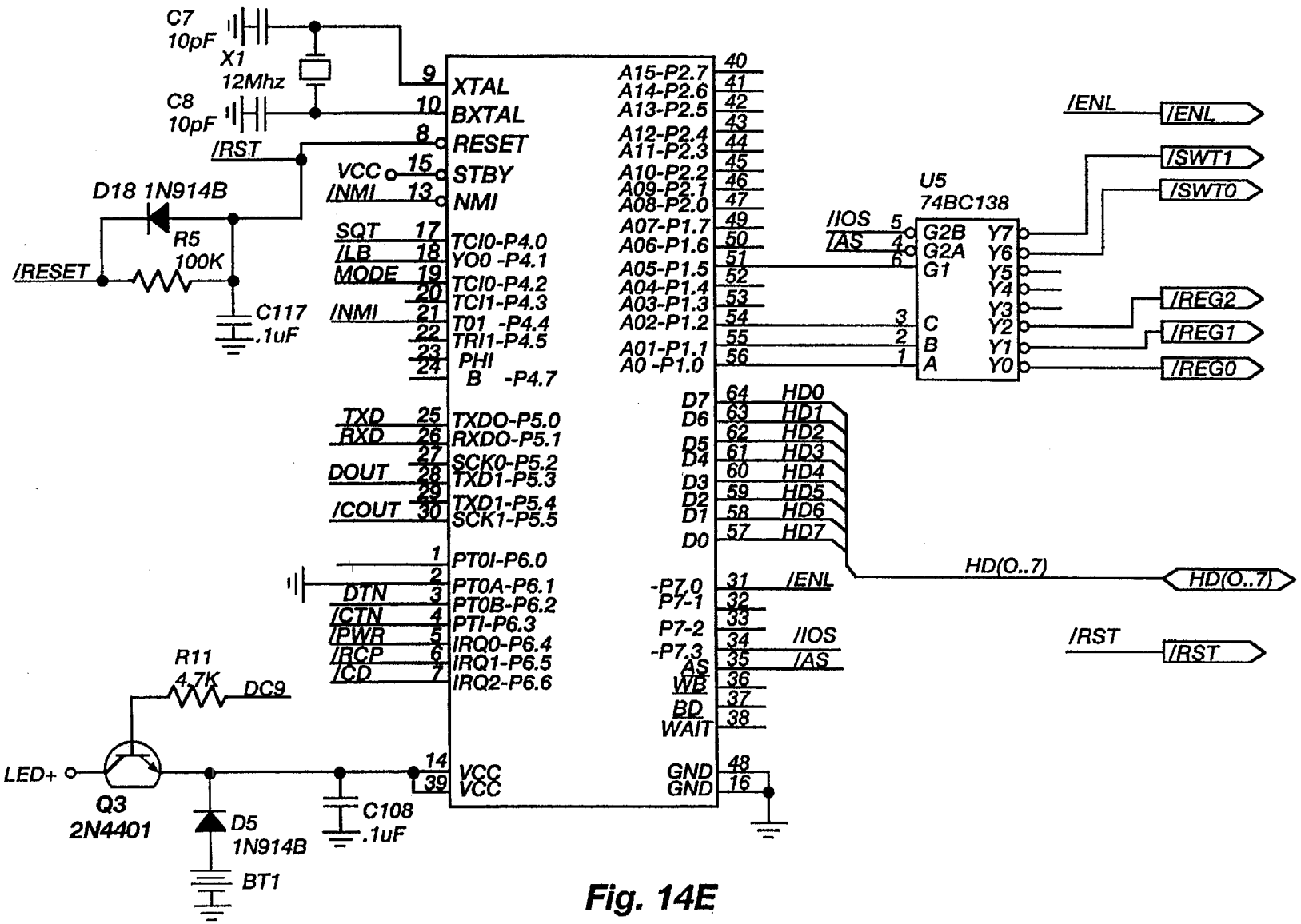
Figure 14G:
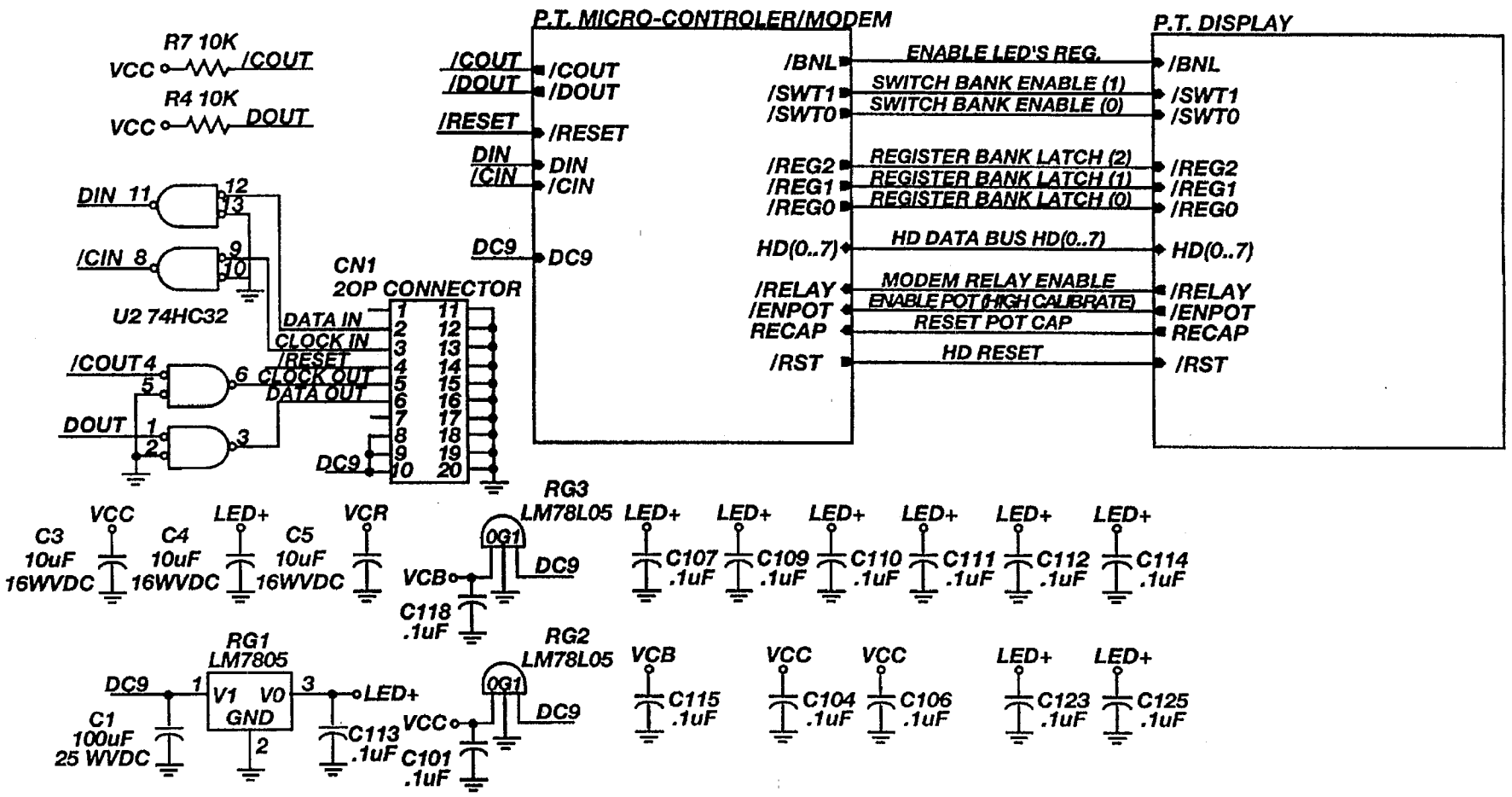
Figure 16A:
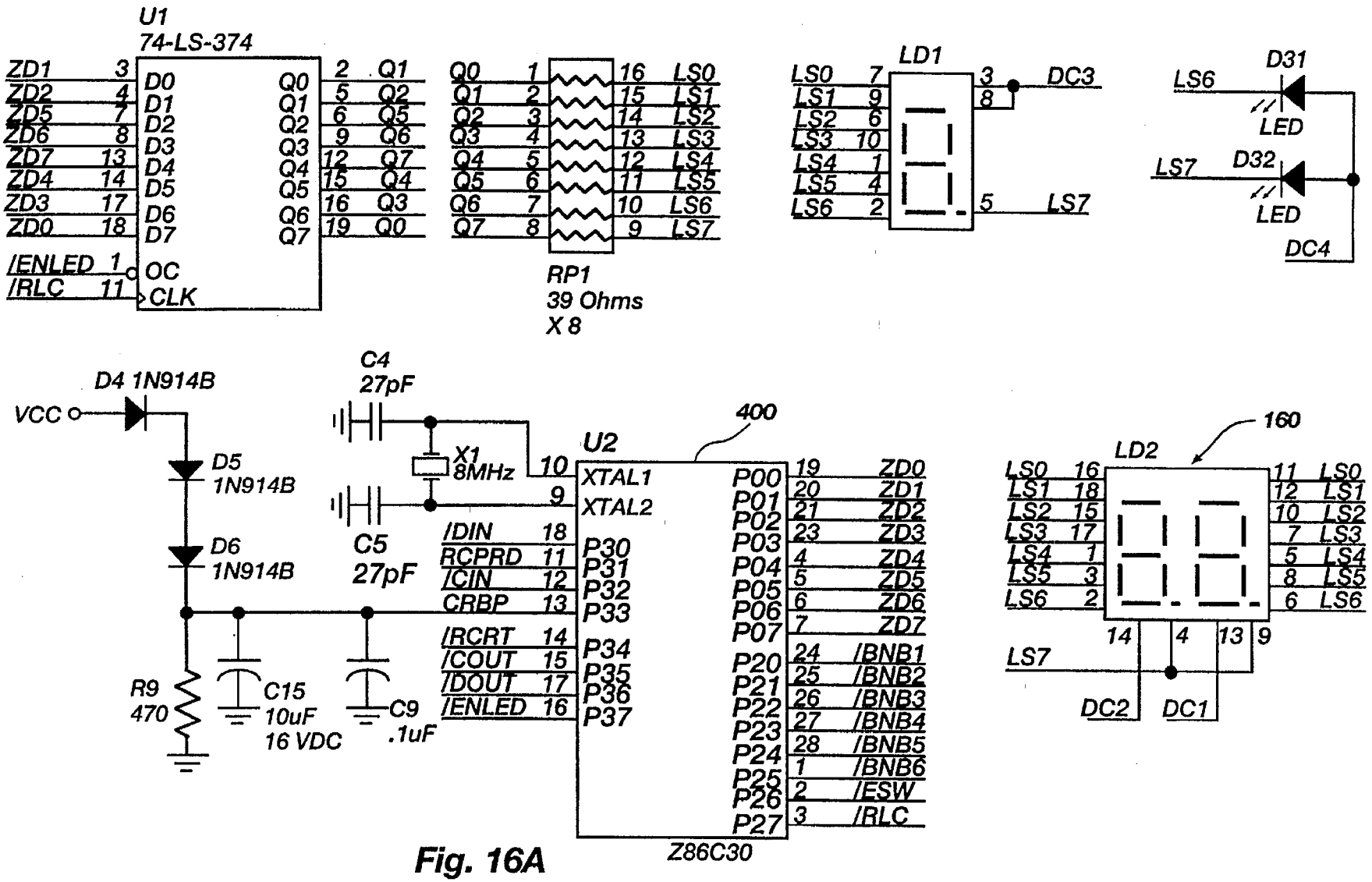
FIGS. 16A, 16B, and 16C are a construction circuit diagram of the third input module of FIG. 15.
Figure 16B:
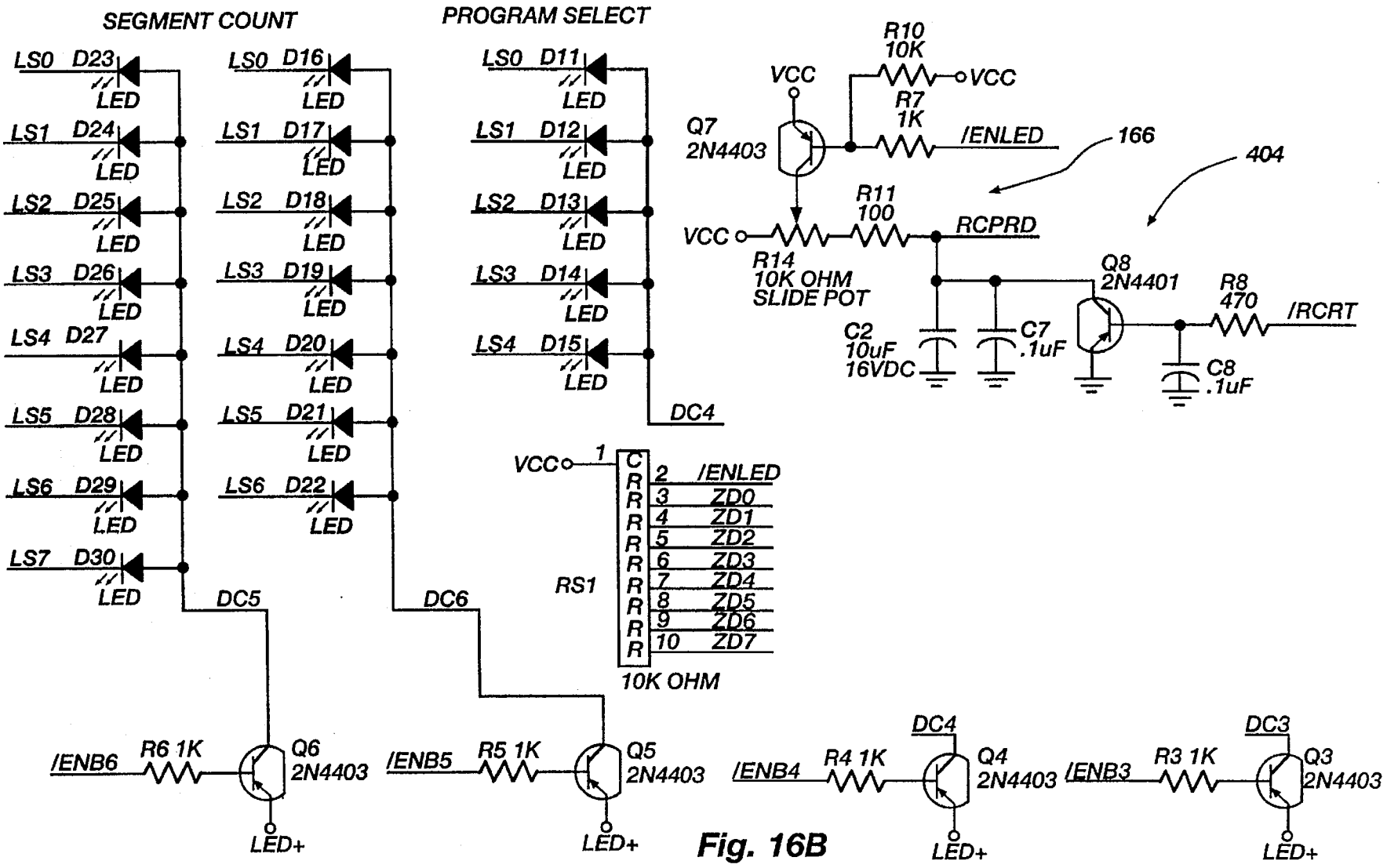
Figure 16C:
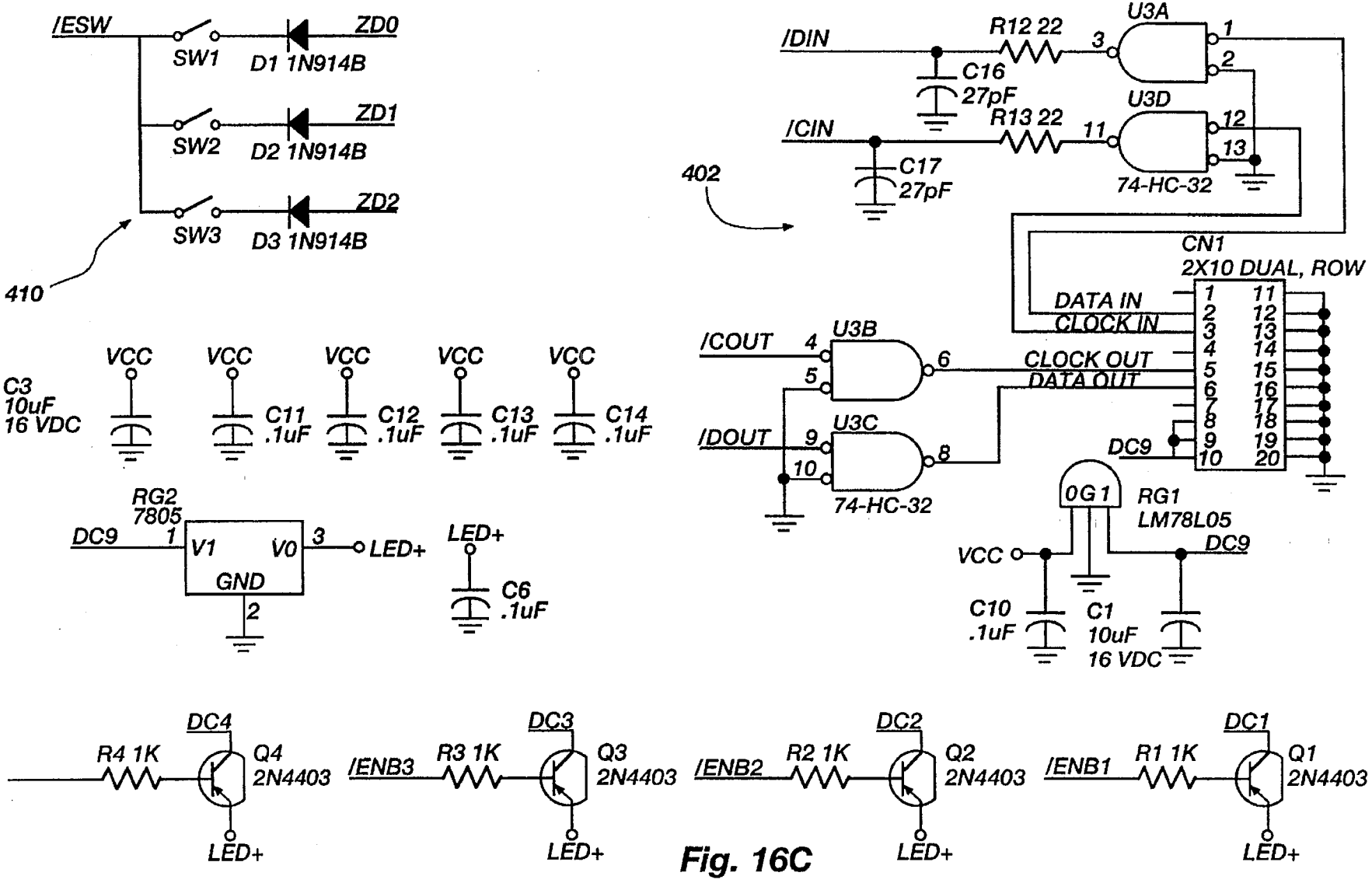

FIGS. 16A, 16B, and 14C is a detailed construction diagram of the various components of an actual circuit of a module 18 of FIG. 15.

Figure 17:
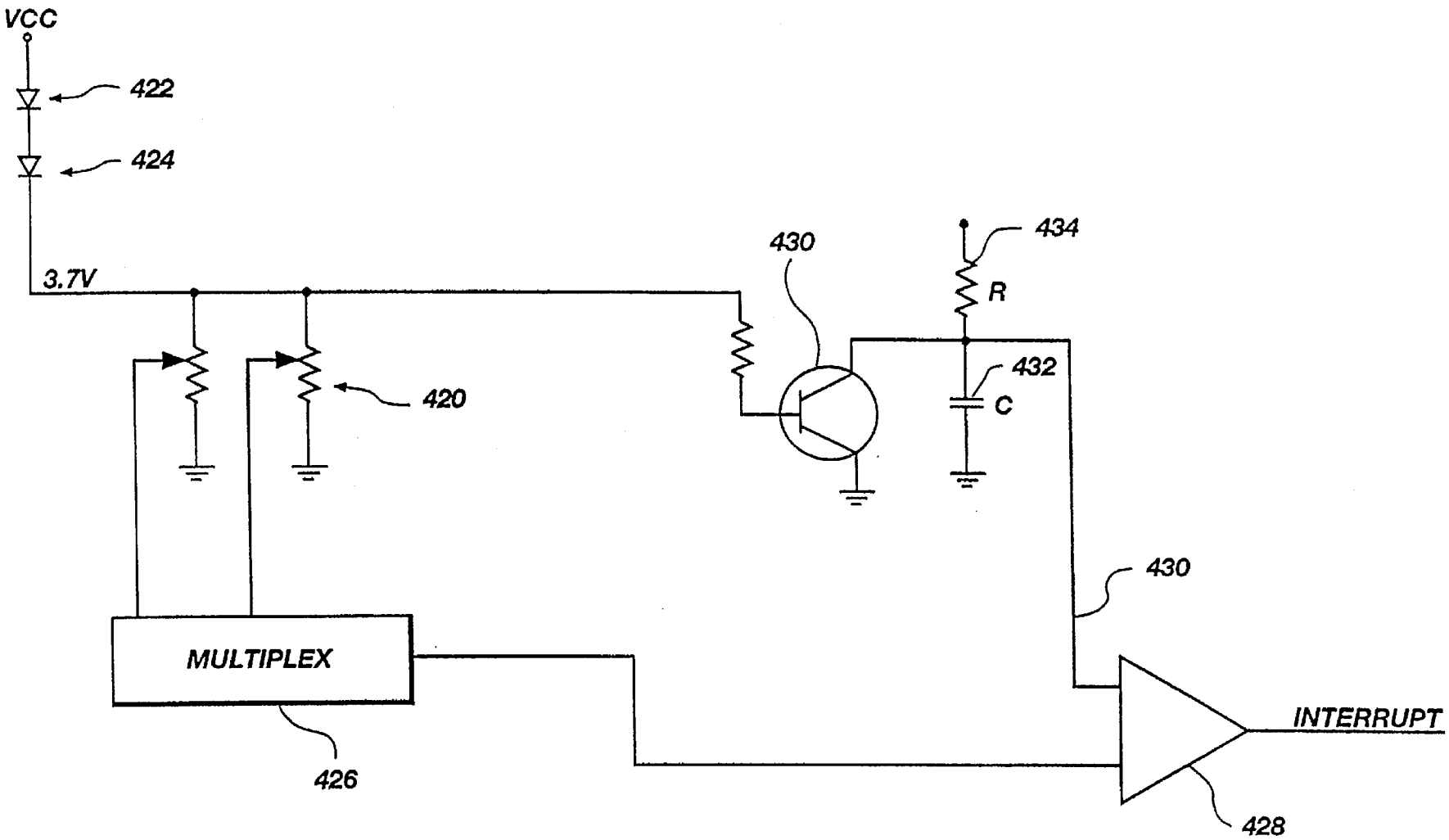
FIG. 17 is a calibration circuit useful to calibrate a variable potentiometer.

FIG. 17 is an alternate calibration circuit for use with a variable resistor as resistor 330 in FIGS. 12A, 12B, and 12C. More specifically, any one of a plurality of variable resistors 420 may be calibrated using a circuit as illustrated in FIG. 17. A control voltage of 3.7 volts is provided. In the circuits such as circuit of FIGS. 16A, 16B, and 14C the control voltage which is dropped by dropping diodes 422 and 424 to a value of 3.7 volts. The 3.7 volts is impressed upon one or upon each of a plurality of potentiometers 420 and connected via a multiplexer 426 as one input to a comparator 428.

Upon activating the entire circuit, the transistor 430 is fired bringing the voltage on the other leg 430 of the comparator 428 to 0. As the voltage rises at the rate selected by value of the components forming the RC circuit 432 and 434, the value coming into the comparator 428 as the other leg will increase until it reaches the equivalent voltage across the resistor 420 thereby generating an interrupt signal. As a result, the related microprocessor which receives the interrupt signal now has a time signal reflective of the range of 0 to the maximum voltage available across the resistor 420 so that the variable signals supplied by the resistor 420 will be actually independent of the total ohmic value of the potentiometer 420.

Stated alternatively, the computer is thereby informed of the time it takes to generate an interrupt signal. That time has to appear on a theoretical graph so that the computer knows both a zero point and the maximum point which occurs at 3.7 volts. Any other time would have to appear upon operation of the potentiometer between 0 and 3.7 volts, a different time will be detected which relates to the graph and in turn results in the microprocessor calculating an accurate fitness level value. Thus, the variable resistor is in fact calibrated because the time necessary to generate the interrupt signal will vary as the individual varies the slide mechanism of the slide pot. The microprocessor is not measuring ohmic values but rather time values related to the ohmic values. The time values are thus independent of the ohmic values of the variable resistor itself.

Figure 18A:
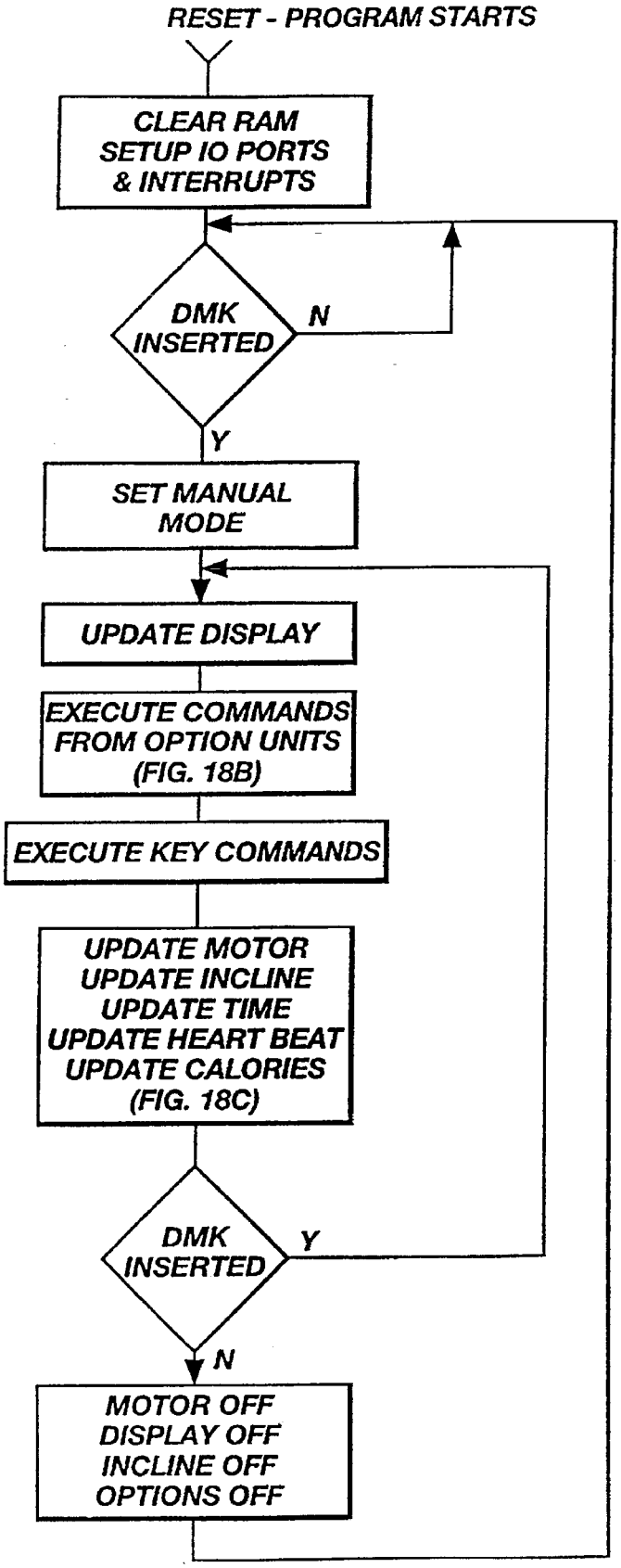
FIGS. 18A, 18B, and 18C are block diagrams representing the logic of the base unit of FIGS. 1 and 7.
Figure 18B:
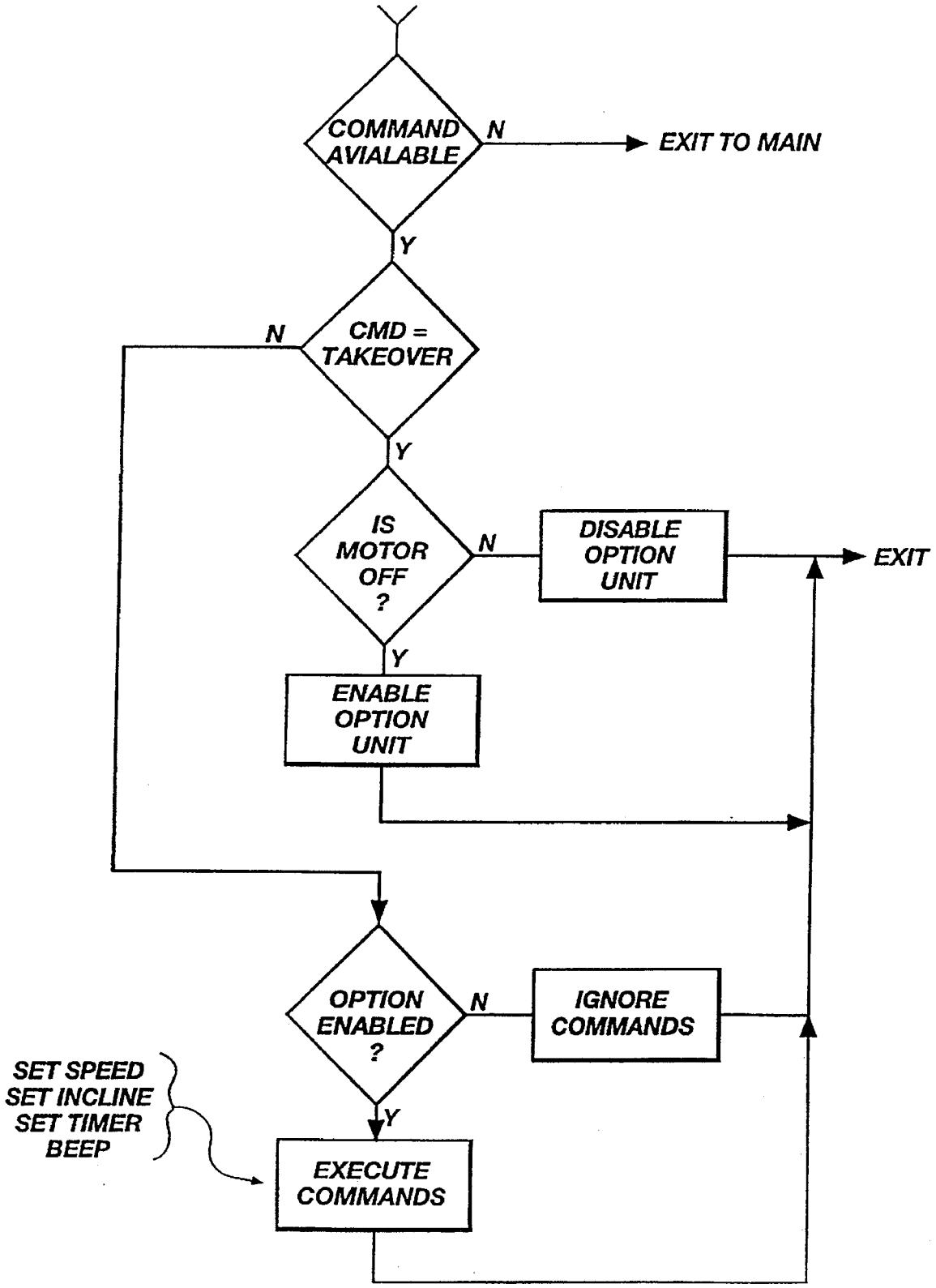
Figure 18C:
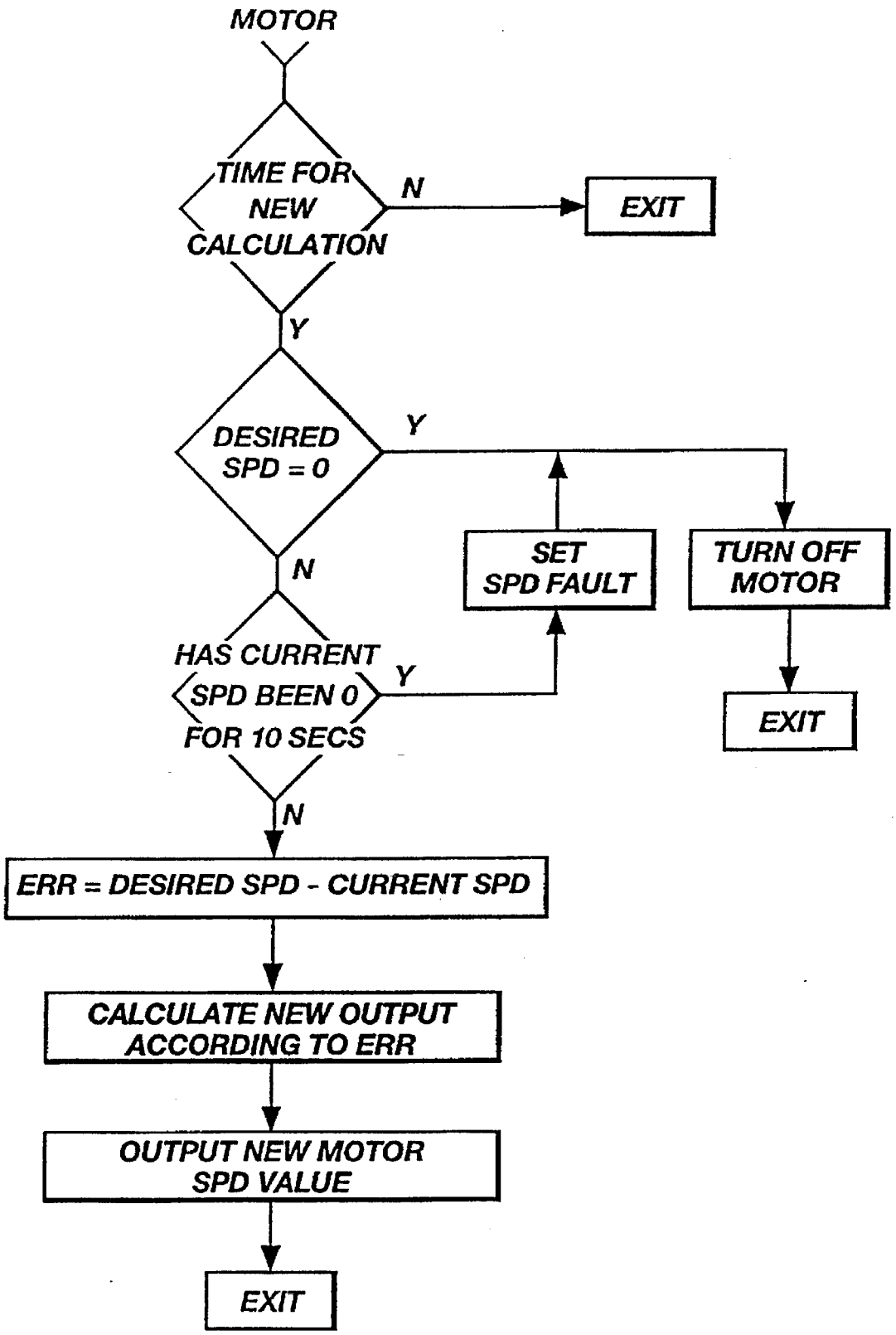
Figure 20:
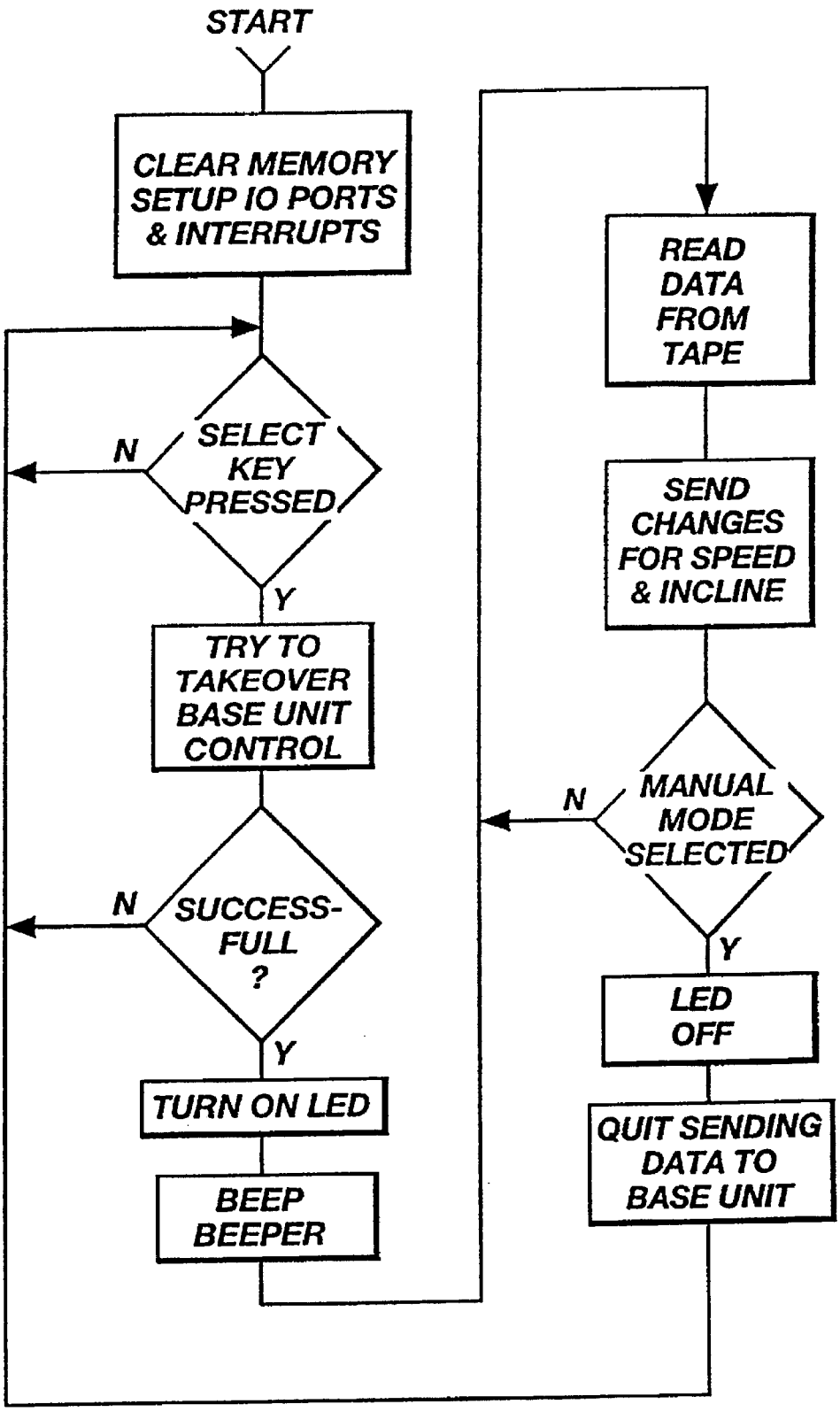
FIG. 20 is the logic flow diagram for the microprocessor of the second input module of FIG. 11.
Figure 19:
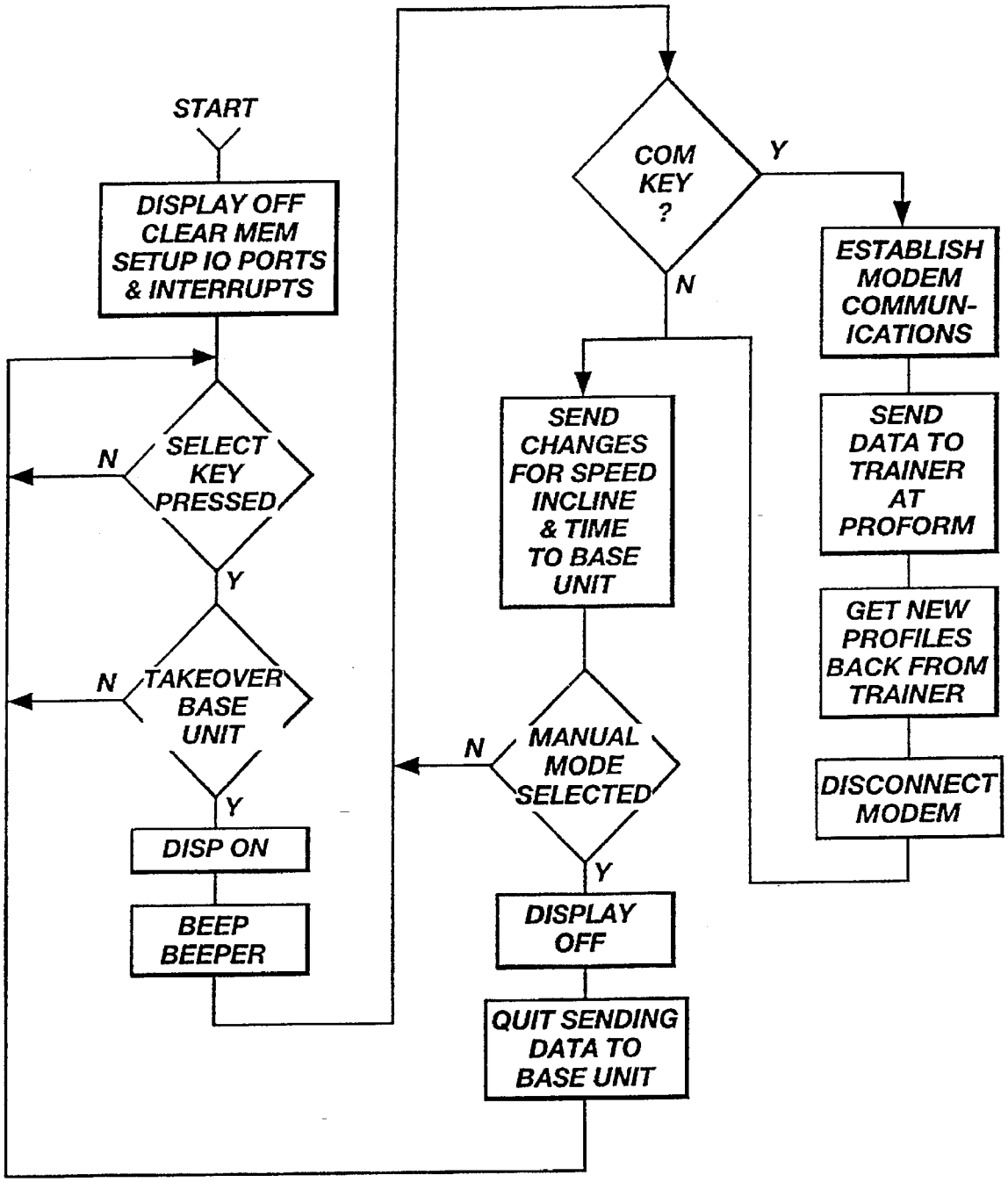
FIG. 19 is the logic flow diagram for the microprocessor of the first input module of FIG. 13.
Figure 21:
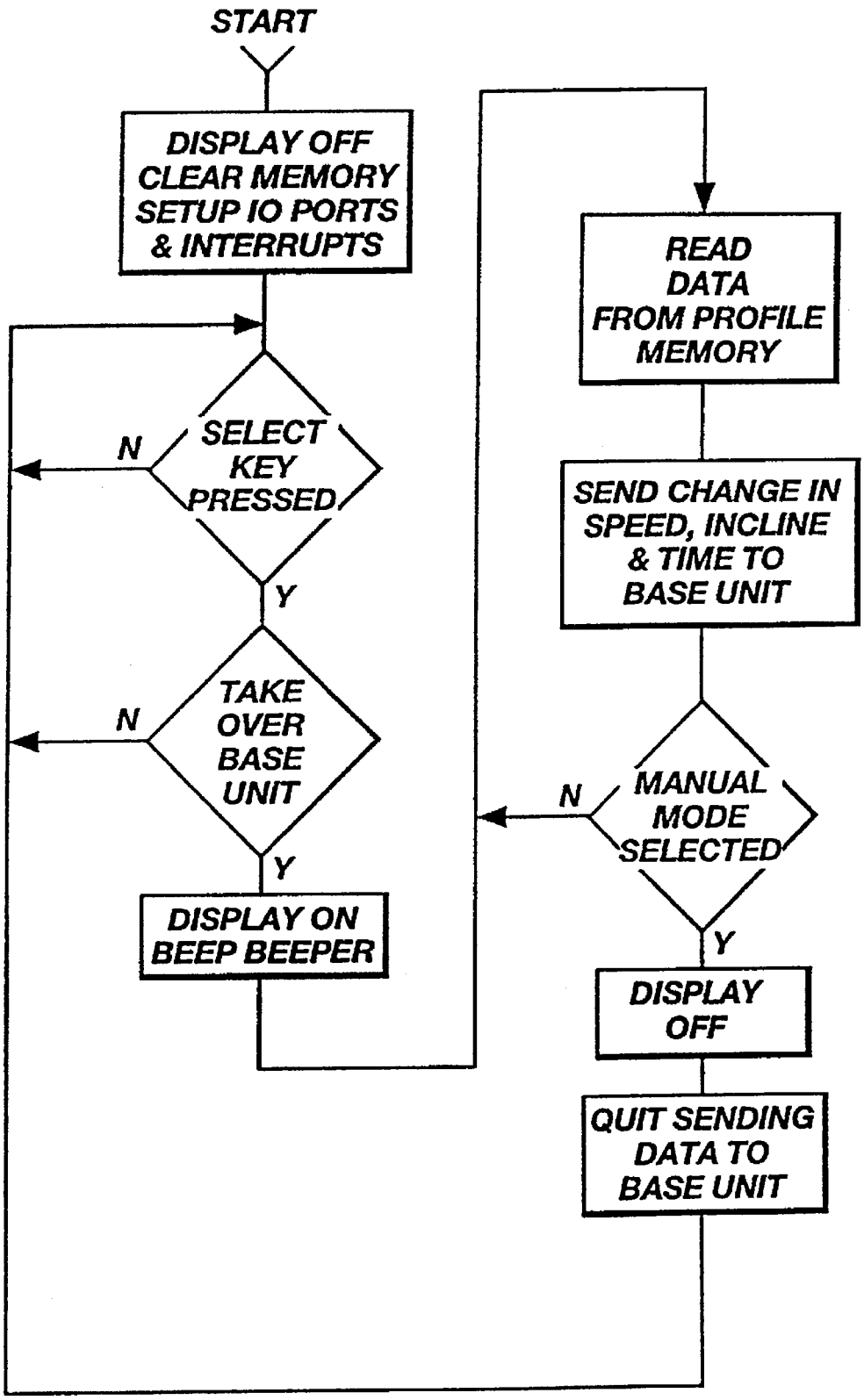
FIG. 21 is the logic flow diagram for the microprocessor of the third input module of FIG. 15.

Referring now to FIGS. 18A, 18B and 18C, the architecture associated with microprocessor 250 in the base unit of the chassis 12 is shown in block diagram format. FIG. 19 and FIG. 20 similarly show the block diagram architecture for input modules 14, 16. FIG. 21 shows the block diagram architecture for the input module 18.

In operation, it can be seen that the user may select one or more modules and connect them with the chassis 12 to form a control console 10 in which the input signals are reflective of a plurality of adjustments to adjustment means to adjust the movement of the moveable member of an exercise machine. In fact a first program and second program may be generated as well as a third.

Indeed, other programs may be generated in one or more of the different modules as desired. Each of these programs supply the plurality of input signals each of which is a separate and unique set reflective of the different program and in turn unique different plurality of adjustments for the adjustment means associated with the involved exercise machine. The user may thereby develop unique exercise routines from an exercise program.

With respect to the personal trainer plus module 14, the user may interconnect with an external source which may be a computer 338 operated by an individual with expertise in the development of exercise programs. The computer 338 may receive data from the user and in turn be input into a separate program to produce alternate programs which may be transmitted back to the module 14 for further transmission to the chassis 12 and for generation of a separate and unique plurality of input signals reflective of the external control signals received from the computer 338 as selected by the computer operator.

Similarly the user may select a variety of different programs by simply selecting a video tape and by operation of an external video system with the tape to supply external control signals to the module 16. Those external control signals in turn cause a separate and unique plurality of input signals to be generated and supplied to the chassis 12 of the involved control console 10.

It should be understood that the above illustrated embodiments are not intended to limit the scope of the claims which themselves define the invention as hereinafter set forth.

What is claimed is:

1. A control and evaluation system for an exercise machine having a frame, a movable element for movement in performance of exercise by a user, and adjustment means positioned between the frame and the movable element for regulating the movement, the system comprising:

sensing means for sensing movement of the moveable element and for providing movement signals indicative of the movement;

first and second ports connectable between a communications device, the first port being remote from the exercise machine and the second port being proximate to the exercise machine;

control means local to the exercise machine for receiving the movement signals, and for providing signals reflective of the movement signals to the second port;

evaluation means remote from the exercise machine for receiving through the communications device and the first port the signals reflective of the movement signals, and for providing through the first port external control signals containing information regarding adjustments to be made to the adjustment means to regulate the movement; and in which the control means receives the external control signals through the communication device and the second port, and provides internal control signals reflective of the external control signals to the adjustment means to regulate the movement.

2. The system of claim 1 further comprising display means positioned for observation by a user during the performance of exercise, the display means being connected to receive the internal control signals and being operable to display indicia reflective of the movement signals.

3. The system of claim 1 in which each of the adjustments is to be made over a specific time period.

4. The system of claim 1 in which each of the adjustments is to be made over a corresponding time period.

5. The system of claim 4 in which the control means comprises means to receive a unique plurality of input signals reflective of a unique plurality of adjustments to the movement in the corresponding time periods.

6. The system of claim 1 in which the exercise machine is a treadmill and the movable element is the treadmill belt, wherein the adjustment means includes speed adjustment means for adjusting the speed of the treadmill belt, and in which the internal control signals are speed signals to vary the speed of the treadmill belt.

7. The system of claim 6 in which the adjustment means further includes incline adjustment means for adjusting the incline of the treadmill relative to a support surface, and in which the external control signals further include incline signals to vary the incline of the treadmill.

8. The system of claim 1 in which the communications device is a telecommunications device.

9. The system of claim 1 in which the evaluation means includes memory means for storing the signals reflective of the movement signals.

10. The system of claim 1 in which the control means further comprises feedback means for generating feedback signals reflective of the movement of the movable element.

11. An exercise machine having a control system for use in connection with an evaluation system that is remote from the exercise machine and that provides external control signals reflective of a designed program to a communication device for reception by the exercise machine, the evaluation system providing the external control signals in response to reception of signals from the exercise machine indicative of use of the exercise machine, the exercise machine comprising:

a frame;

a movable element for movement in performance of exercise by a user;

adjustment means positioned between the frame and the movable element for regulating the movement;

a sensor that senses movement of the moveable element and provides movement signals indicative of the movement;

a port connectable to the communications device; and control circuitry local to the exercise machine that receives the movement signals, and provides signals reflective of the movement signals to the port to be received by the evaluation system, wherein the port receiving the external control signals from the communication device and providing internal control signals reflective of the external control signals to the adjustment means to regulate the movement.

12. The exercise machine of claim 11 further comprising display means positioned for observation by a user during the performance of exercise, the display means being connected to receive the internal control signals and being operable to display indicia reflective of the movement signals.

13. The exercise machine of claim 11 in which the evaluation system includes memory means for storing the signals reflective of the movement signals.

14. The exercise machine of claim 11 in which the control circuitry further comprises feedback means for generating feedback signals reflective of the movement of the movable element.

15. A control and evaluation system for an exercise machine having a frame, a movable element for movement in performance of exercise by a user, and adjustment means positioned between the frame and the movable element for regulating the movement, the system comprising:

a sensor that senses movement of the moveable element and provides movement signals indicative of the movement;

first and second ports connectable between a communications device, the first port being remote from the exercise machine and the second port being proximate to the exercise machine;

a control circuit local to the exercise machine that receives the movement signals and provides signals reflective of the movement signals to the second port;

an evaluation device remote from the exercise machine for receiving through the communications device and the first port the signals reflective of the movement signals, and for providing through the first port external control signals containing information regarding adjustments to be made to the adjustment means to regulate the movement; and in which the control circuit receives the external control signals through the communication device and the second port, and provides internal control signals reflective of the external control signals to the adjustment means to regulate the movement.

16. The system of claim 15 in which a person operates the evaluation device.

* * * * *